US008663037B2

(12) United States Patent
Reeves

(10) Patent No.: US 8,663,037 B2
(45) Date of Patent: Mar. 4, 2014

(54) SOCCER GOAL

(75) Inventor: Francis Reeves, Severn, MD (US)

(73) Assignee: First Goal LLC, Severn, MD (US)

( * ) Notice: Subject to any disclaimer, the term of this patent is extended or adjusted under 35 U.S.C. 154(b) by 262 days.

(21) Appl. No.: 12/654,862

(22) Filed: Jan. 6, 2010

(65) Prior Publication Data

US 2010/0184538 A1 Jul. 22, 2010

Related U.S. Application Data

(60) Provisional application No. 61/143,611, filed on Jan. 9, 2009.

(51) Int. Cl.
*A63B 63/00* (2006.01)

(52) U.S. Cl.
USPC ..... 473/478; 273/402

(58) Field of Classification Search
USPC ..... 273/398–402; 473/476–478, 454–456, 473/197
See application file for complete search history.

(56) References Cited

U.S. PATENT DOCUMENTS

| | | | | |
|---|---|---|---|---|
| 5,080,375 | A * | 1/1992 | Moosavi | 473/478 |
| 5,186,469 | A | 2/1993 | Terris | |
| 5,421,586 | A * | 6/1995 | Amram et al. | 273/400 |
| 5,539,957 | A | 7/1996 | Schmidt | |
| 5,681,045 | A * | 10/1997 | Liao | 273/400 |
| 5,830,089 | A * | 11/1998 | Halter et al. | 473/478 |
| 6,220,776 | B1 * | 4/2001 | Reeves | 403/102 |
| 6,371,873 | B1 * | 4/2002 | Wang | 473/478 |
| 6,629,900 | B2 * | 10/2003 | Wu | 473/478 |
| 6,672,980 | B1 * | 1/2004 | Walsh | 473/478 |
| 7,125,351 | B1 * | 10/2006 | Raber | 473/478 |
| 7,371,195 | B2 * | 5/2008 | Stevens | 473/478 |
| 2002/0193189 | A1 * | 12/2002 | Goldwitz | 473/478 |
| 2003/0153412 | A1 * | 8/2003 | Duba et al. | 473/478 |
| 2003/0181267 | A1 * | 9/2003 | Lee | 473/478 |
| 2004/0036222 | A1 | 2/2004 | Chou | |
| 2005/0067785 | A1 | 3/2005 | Moore, III | |
| 2006/0108742 | A1 * | 5/2006 | Stevens | 273/407 |
| 2007/0281805 | A1 * | 12/2007 | Hsiao | 473/407 |

FOREIGN PATENT DOCUMENTS

WO WO 00/24479 5/2000

OTHER PUBLICATIONS

International Search Report for related International Patent Application No. PCT/US2010/020236, completed Feb. 26, 2010.

* cited by examiner

*Primary Examiner* — Mark Graham
(74) *Attorney, Agent, or Firm* — Edell, Shapiro & Finnan, LLC

(57) ABSTRACT

A game goal according to the invention, such as a soccer goal, collapses both vertically and laterally. The goal includes joints and brackets which facilitate the collapse of the goal such that the during vertical collapse, the forward uprights of the goal fold below the goal's lower rear support members, enhancing the goals transportability. The goal includes stabilizing arms and corresponding receptacles to stabilize the goal in the collapsed position. The goal also has a resistive element which prevents the goal from collapsing too quickly. The goal further incorporates a rotating joint in a top corner bracket which provides an interference fit with a slot in the top corner bracket and a notch in the upright, thereby providing stability when the goal is in the upright or open position for use. Lateral stability of the goal under the weight of a net is enhanced by angle brackets at the ground level of the goal. The angle brackets pivotally connect to the lower crossbar, which folds at its center to facilitate lateral collapse of the goal. The upper crossbar also folds at its center and is attached to the upper corner brackets, which have a pivoting connection to the uprights to facilitate lateral collapse.

24 Claims, 35 Drawing Sheets

SOCCER GOAL

CROSS-REFERENCE TO RELATED PATENT APPLICATIONS

This application claims priority from U.S. Provisional Patent Application No. 61/143,611, filed Jan. 9, 2009. Portions of this application also relates to subject matter disclosed in U.S. patent application Ser. No. 08/288,309, filed Aug. 10, 1994, now issued as U.S. Pat. No. 5,681,231, U.S. patent application Ser. No. 08/958,346, filed Oct. 27, 1997, now issued as U.S. Pat. No. 6,561,931, U.S. patent application Ser. No. 09/179,403, filed Oct. 27, 1998, now issued as U.S. Pat. No. 6,220,776, and U.S. patent application Ser. No. 10/405,475, filed Apr. 3, 2003, now issued as U.S. Pat. No. 7,377,714. All of the above listed patent applications are incorporated herein by reference in their entirety.

BACKGROUND

The present invention relates generally to the field of collapsible structures and, in particular to collapsible game goals, such as collapsible soccer goals.

SUMMARY OF PREFERRED EMBODIMENTS

One embodiment of the invention relates to a soccer goal which collapses to a size suitable for transport. The soccer goal according to the invention collapses both vertically and laterally. A goal according to the invention has top corner brackets which are connected to upper rear support members. Upper rear support members are connected to lower rear support members by a joint. The upper rear support members are connected to top corner brackets at one end and to the lower rear support members at the other end. The opposite ends of the lower rear support members are connected to rear corner brackets. During collapse, the upper and lower rear support members pivot at the joint connecting them, allowing the uprights to fold under at least the lower rear support members. As a result, most of each lower rear support member folds into an area defined to be the front of the uprights.

DETAILED DESCRIPTION OF THE PREFERRED EMBODIMENTS

Figure 1:
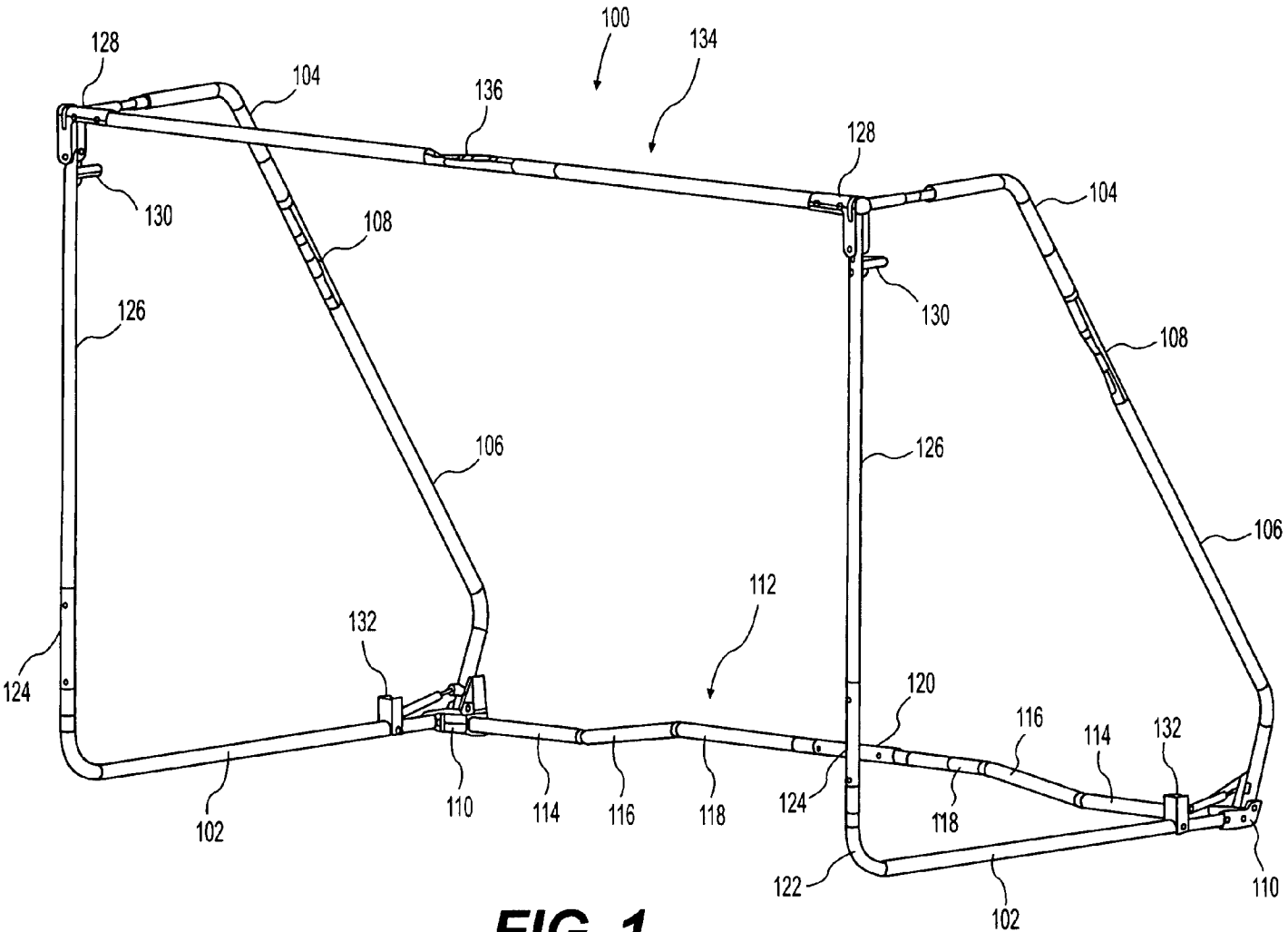
FIG. 1 shows a collapsible soccer goal according to the invention in an upright (non-collapsed position), without a net attached.

FIG. 1 illustrates a collapsible structure, in particular, a collapsible soccer goal, according to the invention. FIG. 1 shows the collapsible soccer goal according to invention in an upright or open position, as it would be used in a soccer game. For purposes of illustration, FIG. 1 shows the soccer goal without a net.

The collapsible soccer goal 100 shown in FIG. 1 has ground members 102. Upper rear support member 104 and lower rear support member 106 are joined by single pivot joint 108. Lower rear support member 106 and ground member 102 are connected to ground bracket 110 by pivot point 210.

Ground bracket 110 is also connected to lower crossbar 112 at pivot point 204. As shown in FIG. 1, lower crossbar 112 preferably has flat sections 114 which contact the ground and elevated sections 118 with transitional sections 116 there between. Elevated sections 118 are joined by folding joint 120. By way of illustration and not limitation, joint 120 may be a double pivot or kickout member joint of the type disclosed at least in FIG. 18 of U.S. Pat. No. 6,220,776 by Reeves (Reeves' 776), which is incorporated herein by reference.

Figure 7:
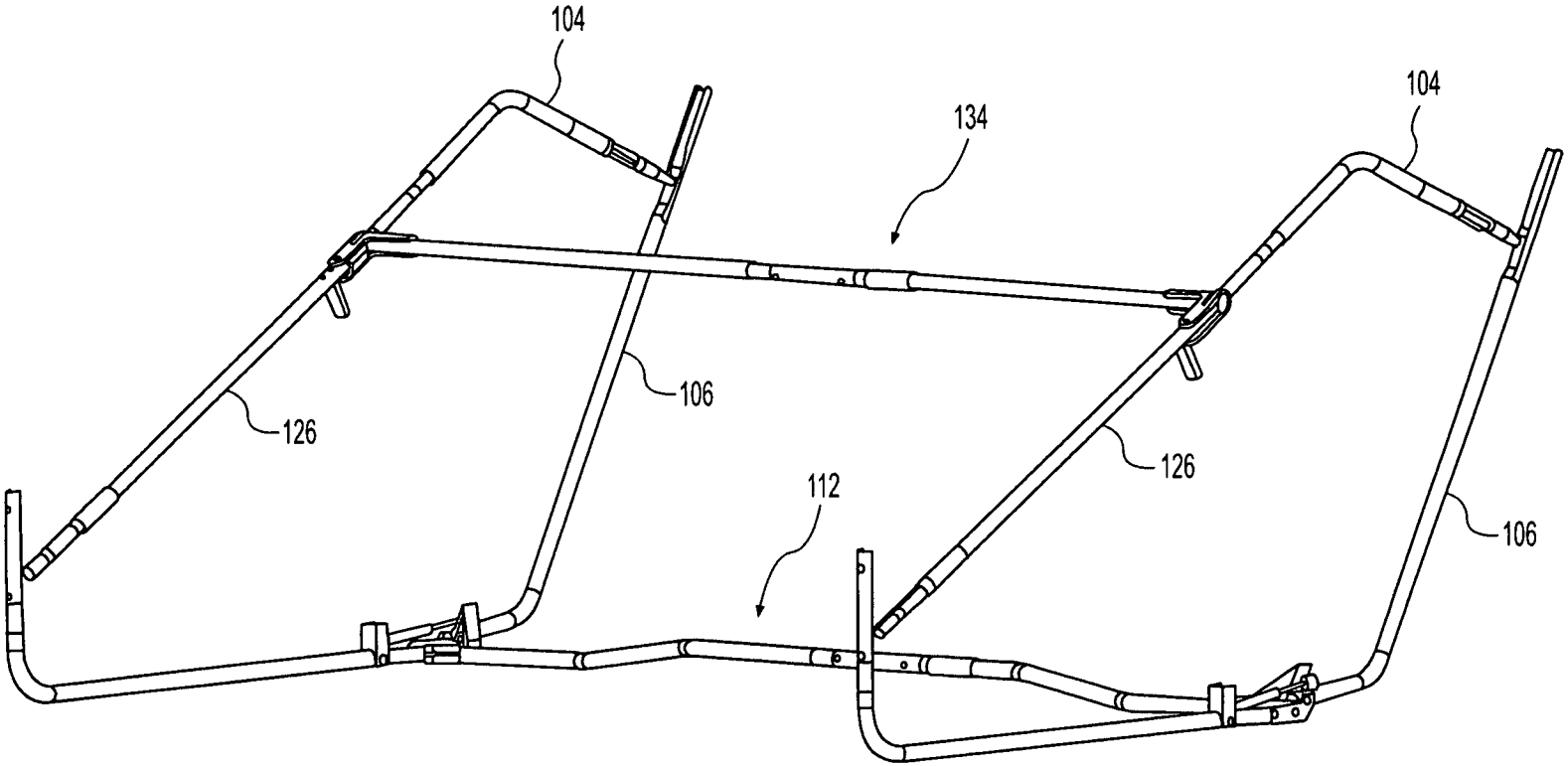
FIG. 7 shows the collapsible soccer goal of FIG. 1 vertically collapsed further from the position shown in FIG. 5, i.e., as the structure collapses to the point where the rear support member of the goal is even with a plane formed by the uprights of the goal.
Figure 8:
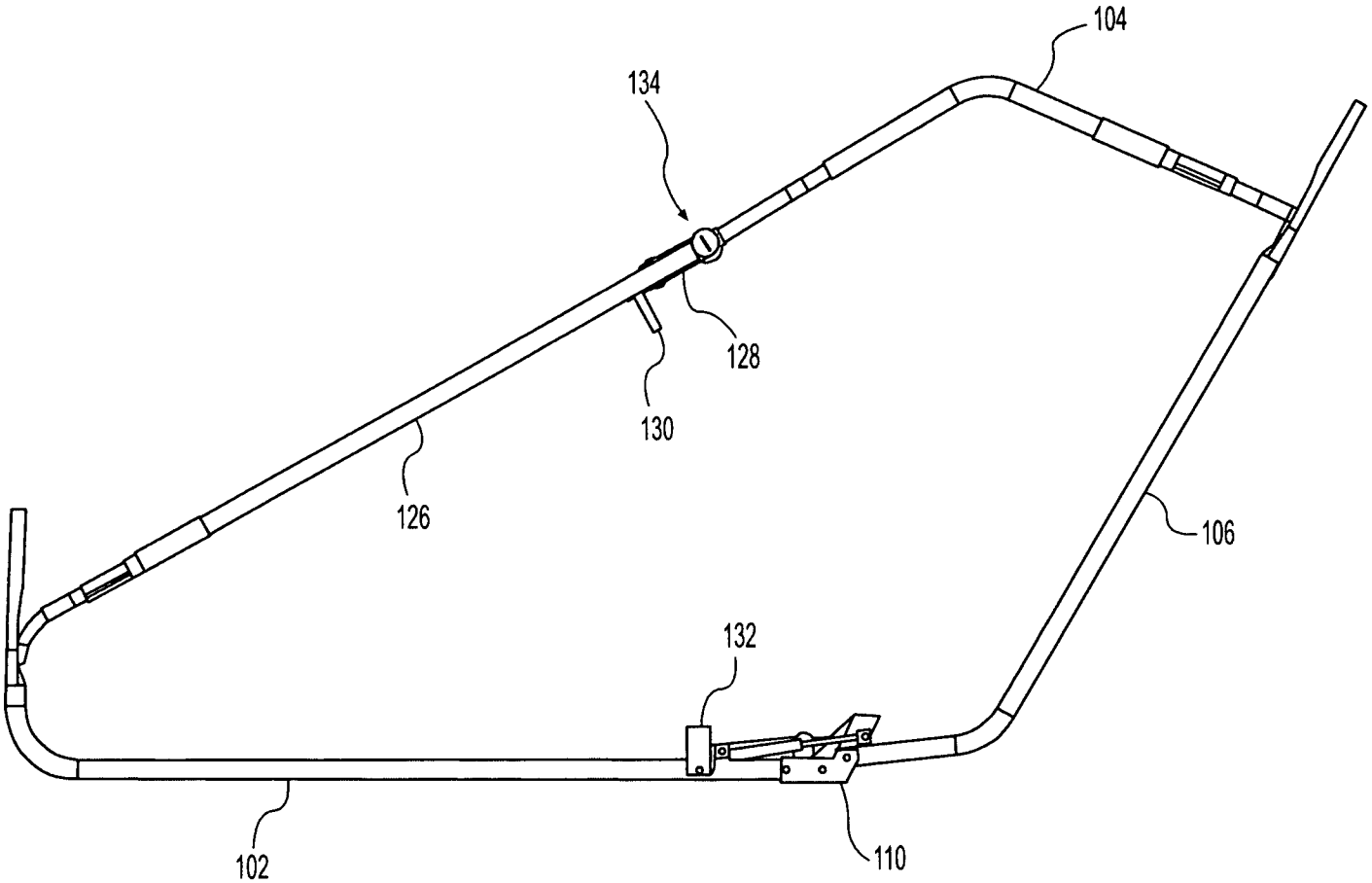
FIG. 8 is a side view of the collapsible soccer goal as shown in FIG. 7.

By way of illustration and not limitation, ground member 102, corner member 122 and socket portion of joint 124 may be of the type disclosed at least in FIGS. 7 and 8 of U.S. Pat. No. 5,681,231 by Reeves, (Reeves '231) which is incorporated herein by reference. Ground member 102 is an elbow having a gaped arm and an ungapped arm. The portion of member 102 that touches the ground is the ungapped arm and it connects to ground bracket 110. The gapped arm is the socket portion of joint 124. The elbow is the 90 degree corner bend of member 122.

Figure 10:
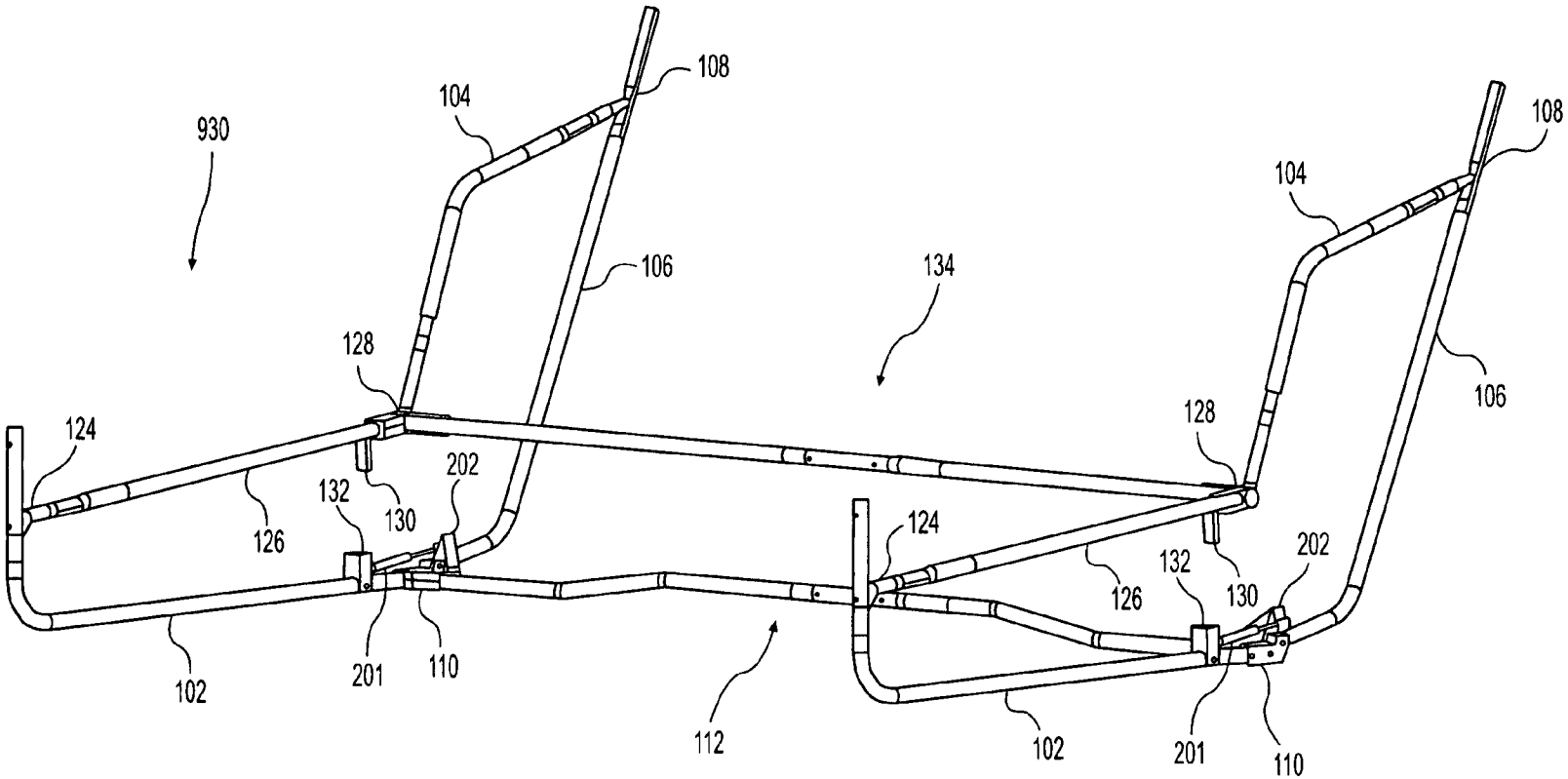
FIG. 10 illustrates the collapsible soccer goal of FIG. 1 vertically collapsed still further from the position shown in FIG. 8, i.e., as the structure collapses to the point where the upper rear support member crosses over and in front of a plane aligned with the upright of the goal.

By way of illustration and not limitation, joint 124 may also be of the type disclosed at least in FIG. 10 of U.S. Pat. No. 7,377,714 by Reeves (Reeves '714), which is incorporated herein by reference. At the forward or front bottom portion of the soccer goal, each ground member 102 connects to transitional corner member 122. Transitional corner member 122 is shown in FIG. 1 having a curved shape, although other suitable shapes may be used as well. Transitional corner member 122 connects to one end of joint 124. Also connected to joint 124 is one end of upright member 126, which corresponds to the "moveable member" as disclosed in Reeves '714. The other end of upright member 126 connects to top corner bracket 128.

Stabilizer arm 130 protrudes from upright 126 such that as the goal is collapsed, stabilizer arm 130 is inserted into square receptacle 132 to keep the upper crossbar from interfering with the lower crossbar during the horizontal folding process as discussed further herein. Stabilizer arm 130 can be separately attached as an element to upright 126 or can be formed integrally with upright 126. Receptacle 132 and the corresponding mating stabilizer are 130 are not limited to the mating square shapes shown and may be any other suitable supporting geometric configuration, such as triangular and round shapes.

Upper rear support member 104 connects through other elements to the top corner bracket 128, as discussed further herein. Top crossbar 134 also connects to top corner bracket 128, as discussed further herein. Top crossbar 134 connects to double pivot joint 136, which is a joint having a linkage that allows up to 180 degrees of motion. By way of illustration and not limitation, double pivot joint 136 may be of the type disclosed in at least at FIG. 18 of Reeves '776, which is incorporated herein by reference.

Figure 2:
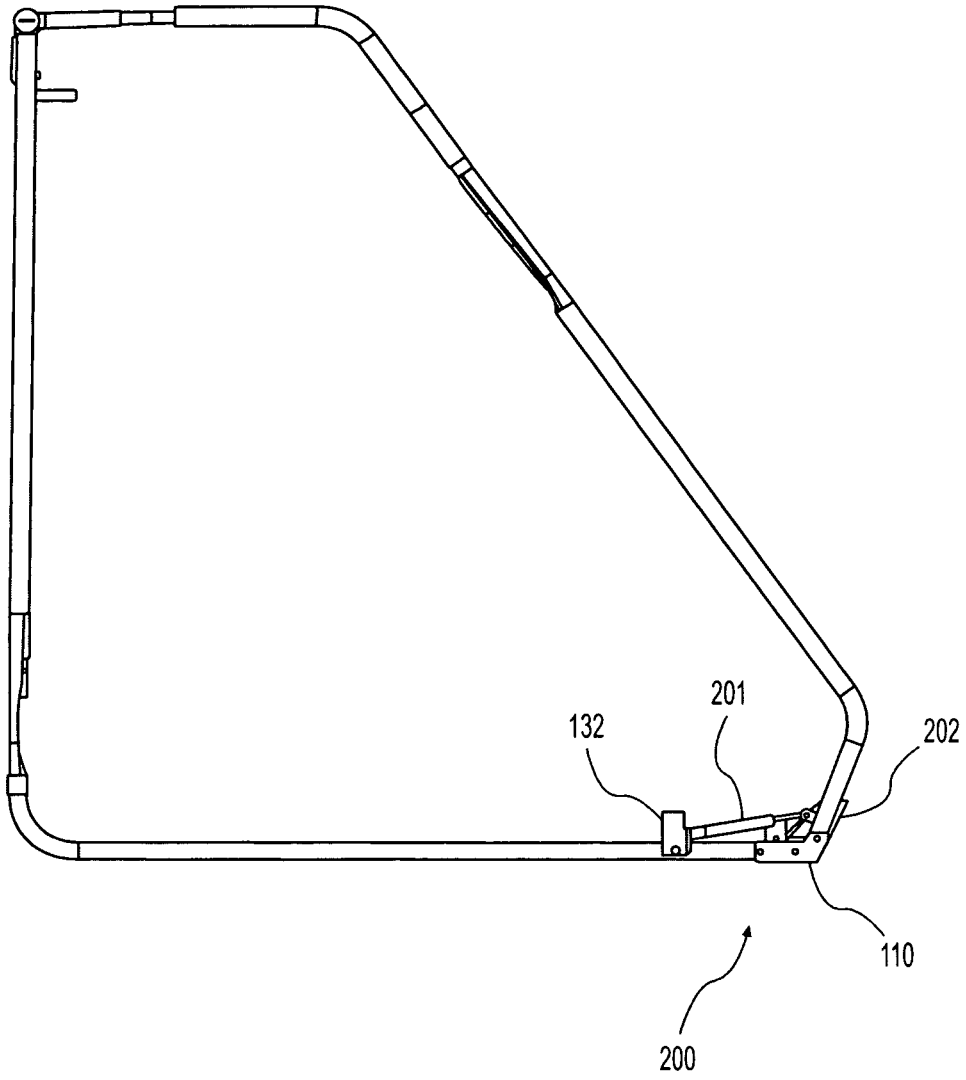
FIG. 2 is a side view of a soccer goal as shown in FIG. 1.

The side view in FIG. 2 shows a rear corner bracket assembly 200 including elements associated with ground bracket 110, which are described further herein. These include motion dampening or resistance element 201, which limits the speed at which the goal collapses, thereby preventing injuries which might occur if the goal collapsed too quickly. FIG. 2 also shows angle support element 202, which helps to keep the rear support members square in relationship to the overall goal, as discussed further herein.

Figure 3:
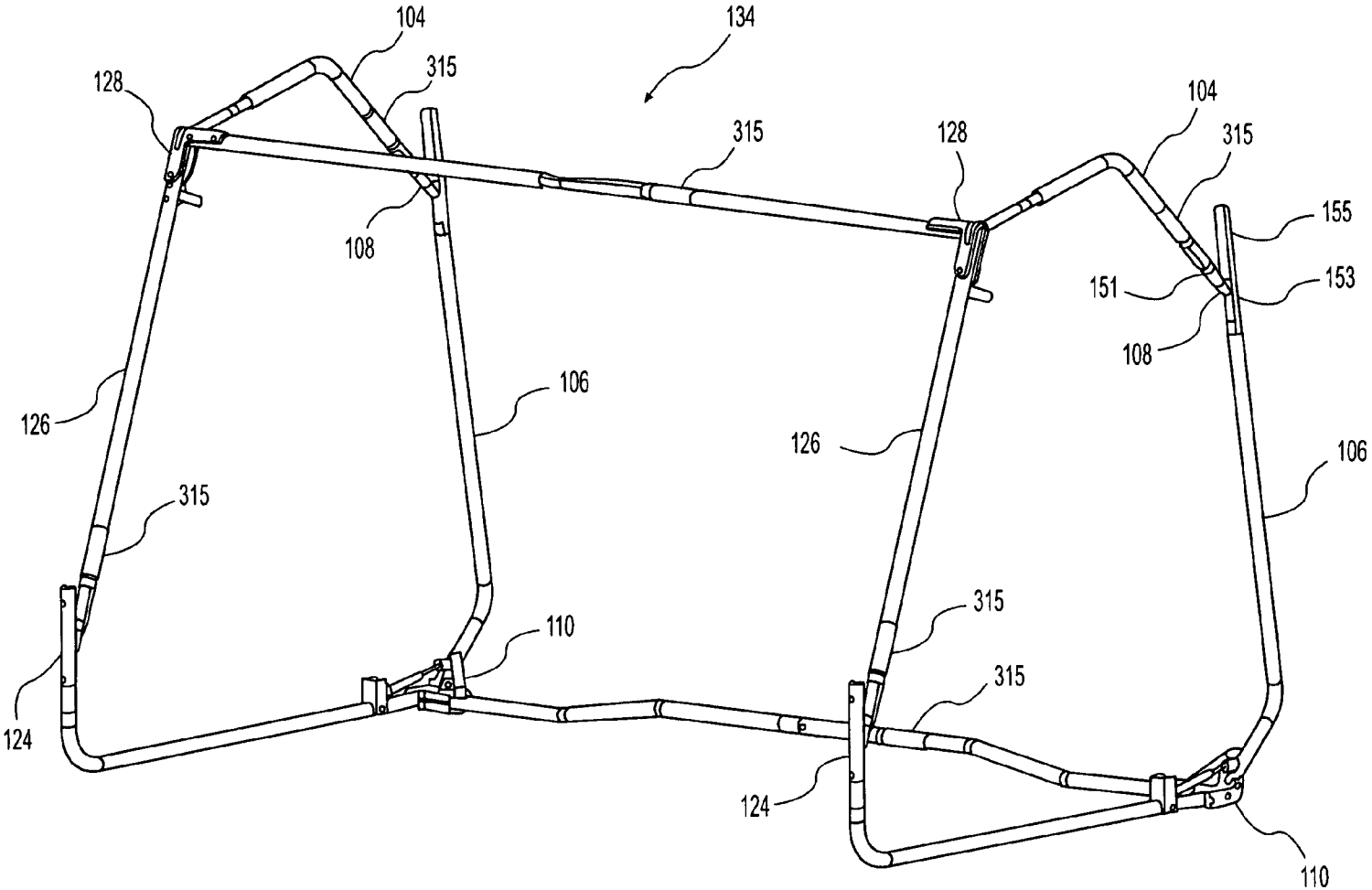
FIG. 3 shows the collapsible soccer goal of FIG. 1 during the initial stage of vertically collapsing the goal. Rear support members begin to move towards the back of the goal.

The goal according to the invention collapses both vertically and laterally. In operation, the goal preferably is first collapsed vertically. FIG. 3 illustrates the initial stage of the vertically collapsing goal. Mechanisms, such as sliding joint lock sleeves 315 which engage pivot joints 108 and flex link joints 124 in a fixed, non-pivoting position are moved to a disengaged or open position, such that the members of joints 108 and 124 are free to disengage and pivot. As shown in FIG. 3, pivot joint 108 has a reduced end pivoting member 151 which pivots about a single point 153, for example by rotating around a bolt (not shown), to engage and disengage from socket 153. A similar pivot joint is illustrated at least as element 2205 in U.S. Pat. No. 6,561,931 (Reeves '931), which is incorporated herein by reference. A user collapsing the goal then applies pressure to upper crossbar 134 from the front of the goal toward the back. Uprights 126 begin to move toward the back of the goal, by means of joints 124, and joints 108 and rear ground brackets 110 and top corner brackets 128 beginning to fold. As a result, the upper crossbar 134 and uprights 126, being permanently joined by the top corner brackets 128, begin to move together toward the back of the goal. The upper rear support members 104 and lower rear support members 106 pivot at joints 108. As the user applies pressure to the upper crossbar 134, both rear support members 104 and 106 being to move backward, i.e., upward and outward from the center of the goal. This motion is in contrast to conventional collapsible goals in which the rear support members begin to fold inward and down into the center of the goal.

Figure 4:
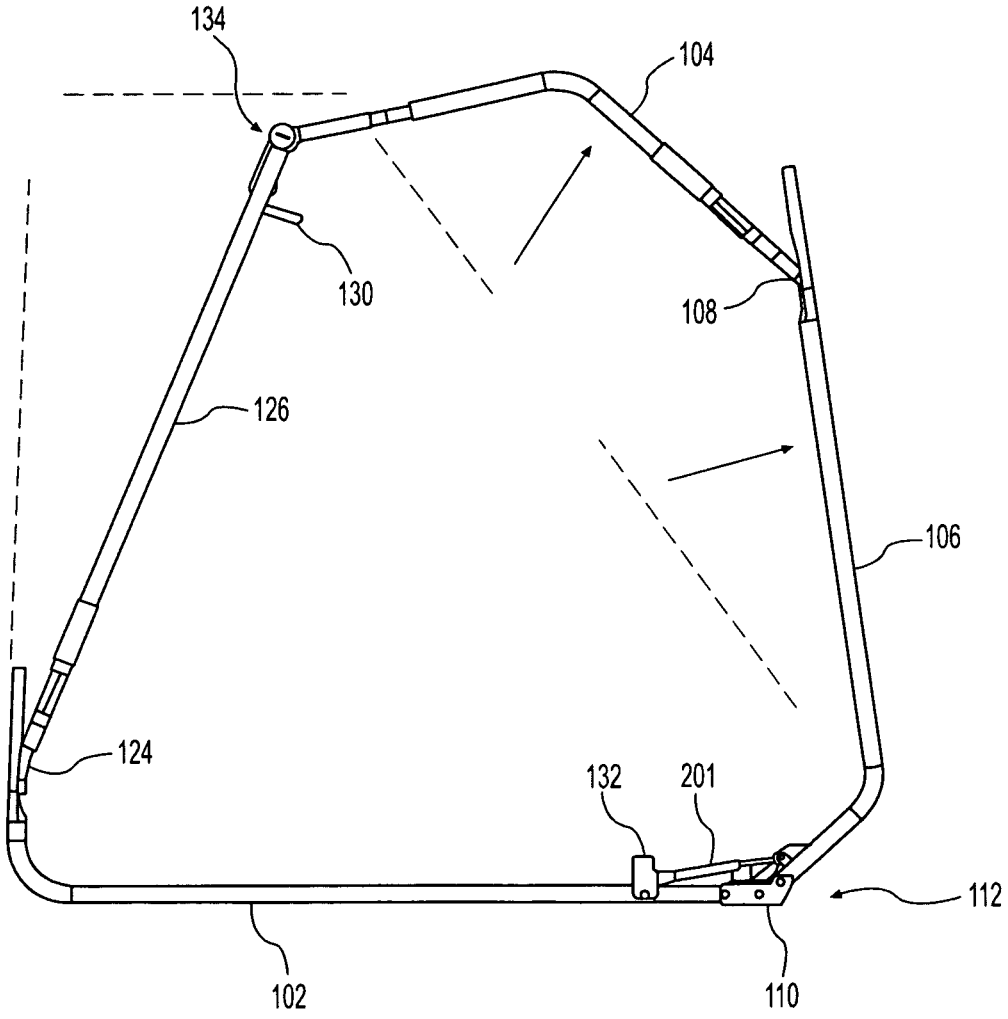
FIG. 4 is a side view of the collapsible soccer goal as shown in FIG. 3.

FIG. 4 further illustrates the conditions shown in FIG. 3. Dashed lines and arrows in FIG. 4 show the direction of movement of the goal as it is being collapsed from the upright position. The dashed lines in FIG. 4 illustrate the position of upright 126, lower rear support member 106 and upper rear support member 104 when the goal is in the upright or open position. FIG. 4 further illustrates that as pressure is applied to upper crossbar 134, upright member 126 moves toward ground member 112, and upper and lower rear support members, 104 and 106 respectively, move upward and outward from their position in the upright goal.

Figure 5:
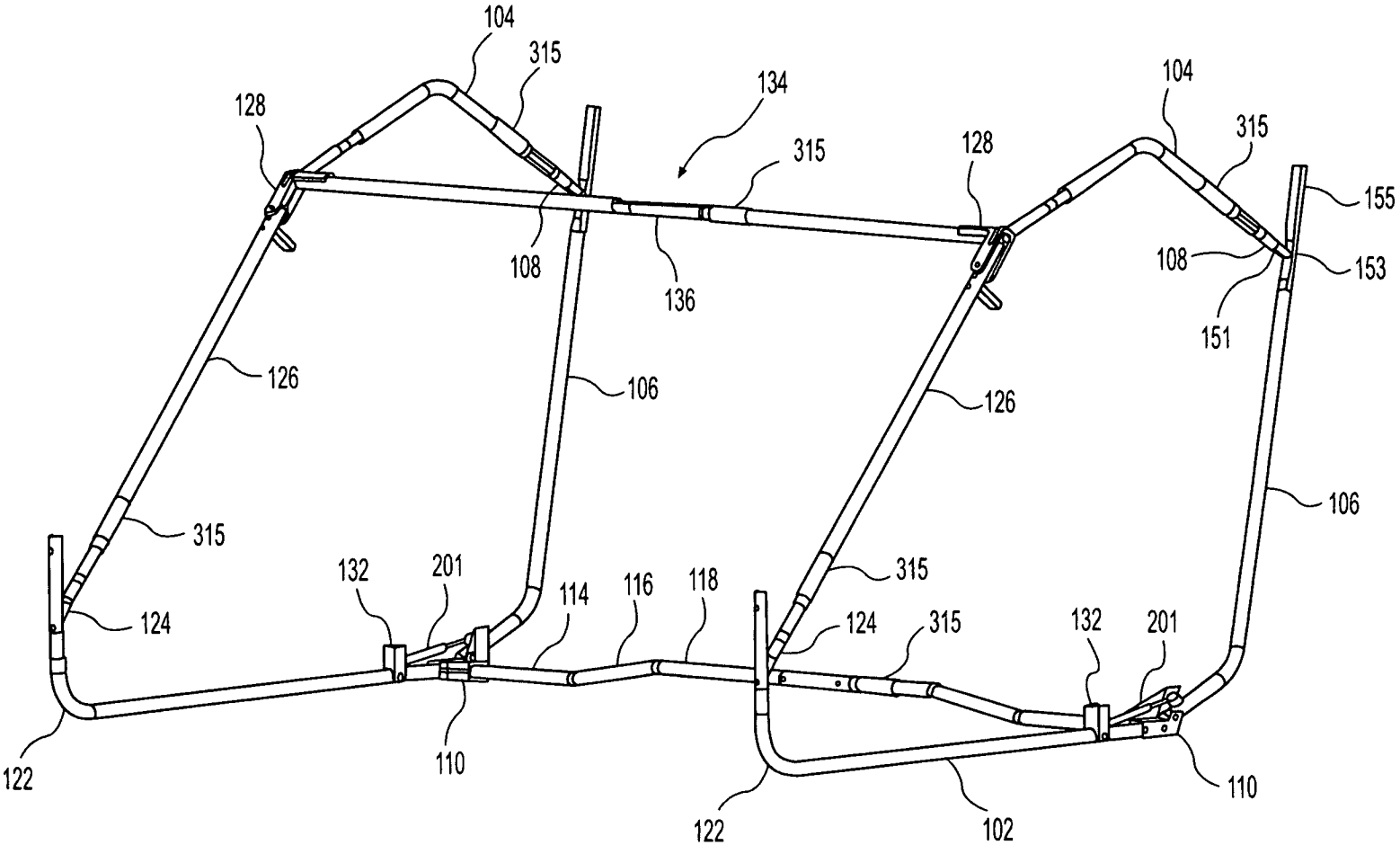
FIG. 5 shows the collapsible soccer goal of FIG. 1 as it is vertically collapsed further from the position shown in FIG. 3., i.e., as the structure collapses, the rear support members are behind a plane formed by the uprights of the goal.
Figure 6:
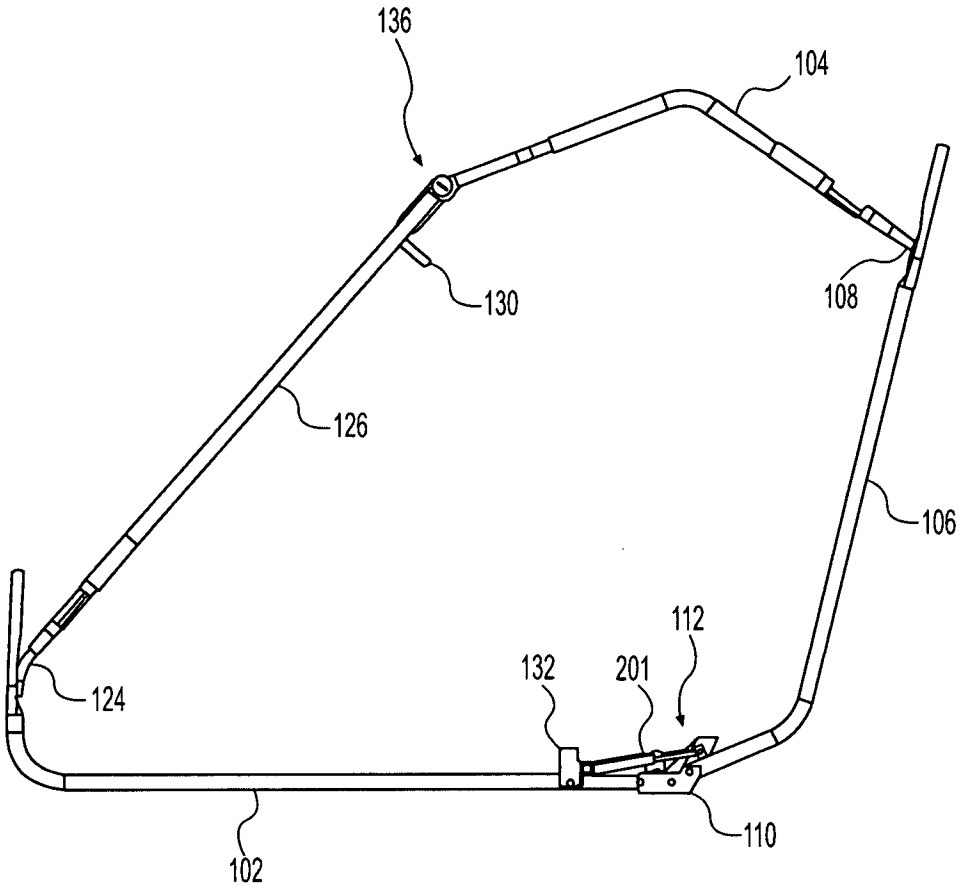
FIG. 6 is a side view of the collapsible soccer goal shown in FIG. 5.

FIGS. 5 and 6 illustrate the relative positions of the goal components described above, as the goal is further collapsed.

FIGS. 7 and 8 illustrate the collapsing goal at a point just before the upper rear support member 104 crosses over and in front of a plane formed by the uprights 126 and crossbar 134. This position is reached just before the rear support member 104 begins to fold in front of or on top of upright 126, or the same position as just before the upper crossbar 134 and uprights 126 fold under rear support member 104. As the goal is collapsed further from this point, upper and lower rear support members 104 and 106 begin to travel forward toward the open or front of the goal into a region relative to a reference plane aligned with uprights 126.

Figure 9:
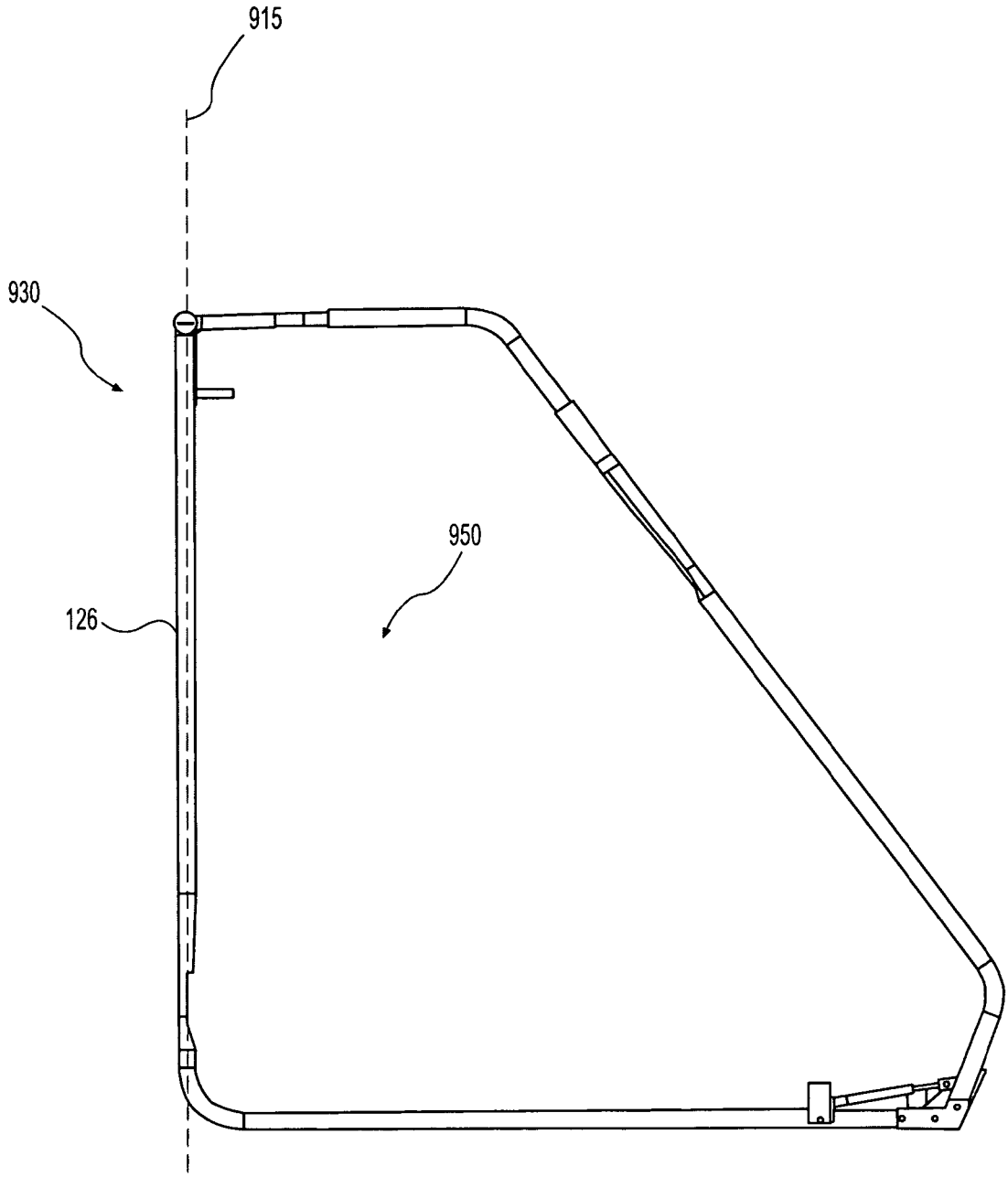
FIG. 9 illustrates a plane aligned with the upright of the goal. This plane moves with the upright as the goal is folded.
Figure 9A:
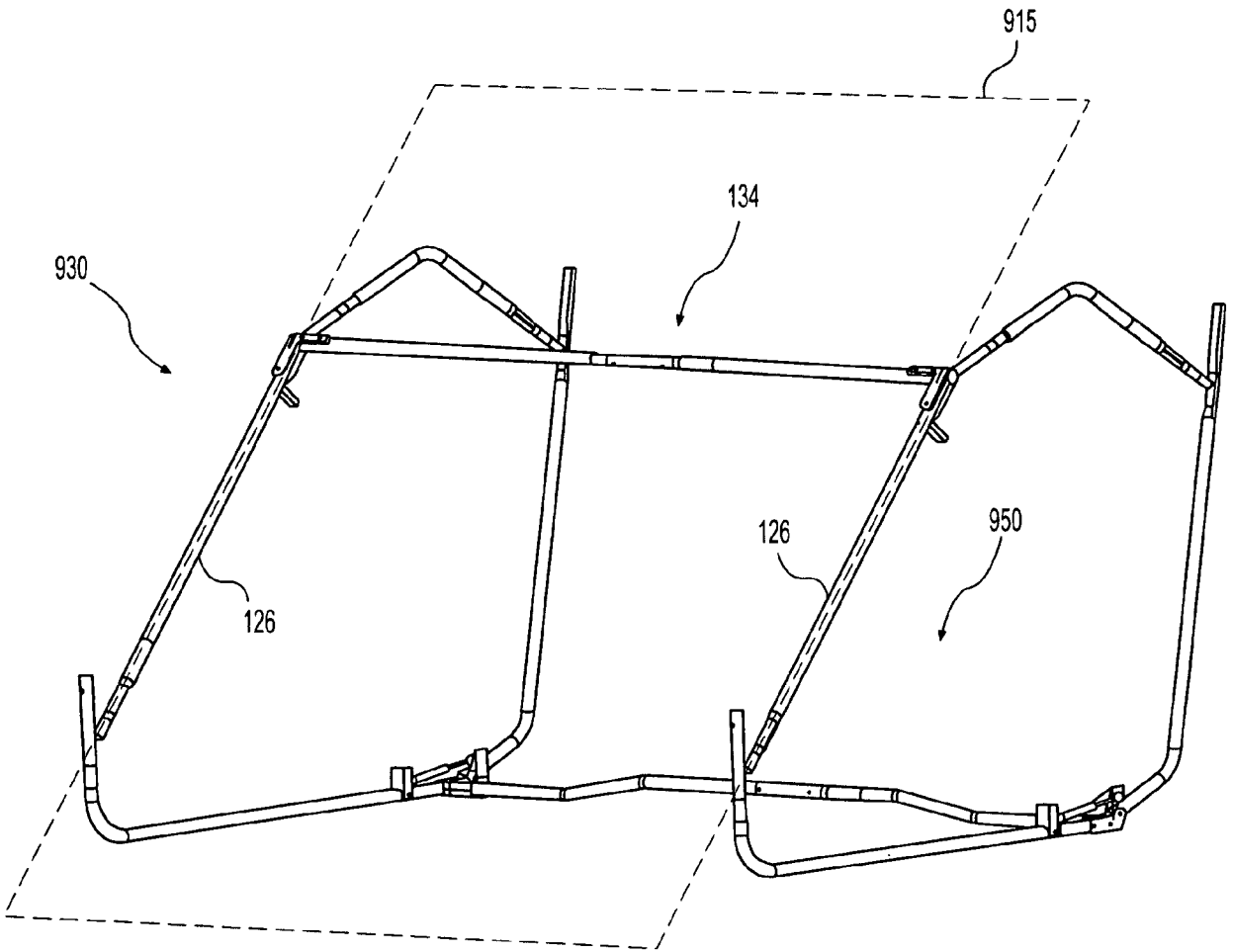
FIG. 9*a* illustrates a flat reference plane aligned with the uprights as the goal is being folded as in FIG. 5.

For ease of reference, FIG. 9 illustrates the location of the region 930 relative to the reference plane 915 when the goal is in the open position. FIG. 9 also shows a second region 950 relative to reference plane 915. As shown in FIG. 9 flat reference plane 915 is located through the center of both uprights 126 and through the center of crossbar 134 and is parallel to the scoring plane of the goal in the open position. Plane 915 delimits the two spatial regions 930 and 950. Spatial region 930 is the area in front or on top of the uprights 126. Spatial region 950 is the area behind or below the uprights 126. Thus, plane 915 is a reference plane that allows us to describe the unique folding design of the soccer goal in FIG. 1. Plane 915 moves with uprights 126, as they fold. FIG. 9*a* shows flat reference plane 915 aligned with uprights 126 as the goal is being folded as in FIG. 5.

Figure 11:
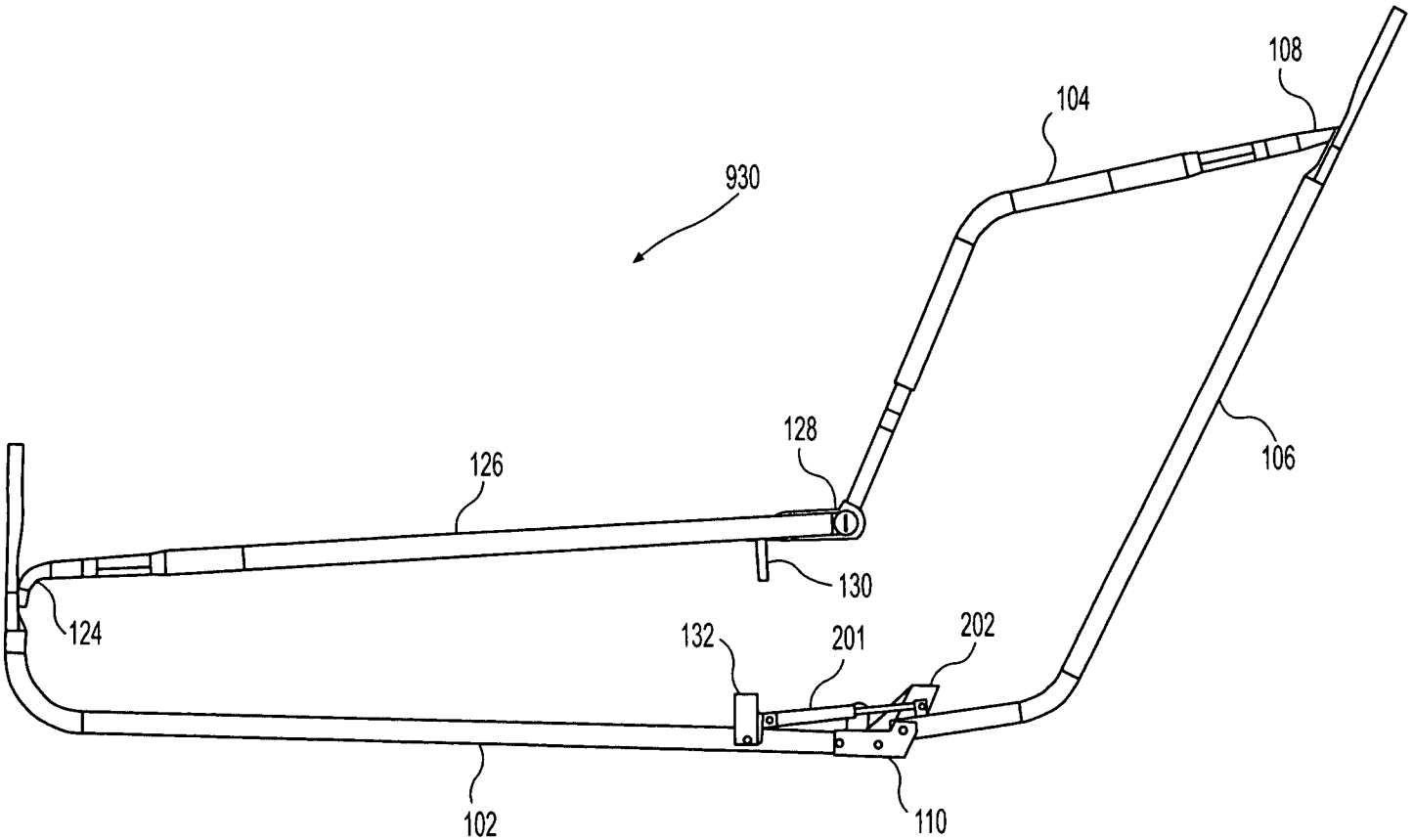
FIG. 11 is a side view of the collapsible soccer goal as shown in FIG. 10.

FIGS. 10 and 11 illustrate the goal according to the invention as the upper crossbar 134 is pushed closer to the lower crossbar 112, causing uprights 126 to move downward toward ground members 102. As a result of the motion facilitated through joints 124 and 108 acting with top corner brackets 128 and ground brackets 110 with motion dampening or resistance members 201 and angle support members 202, as upper crossbar 134 approaches lower crossbar 112, upper and lower support members 104 and 106 begin to move toward the front of the goal. In FIG. 10 upper rear support member 104 is located in region 930, namely region in front of or on top of uprights 126 This is in contrast to FIG. 1. which shows upper rear support member 104 located in region 950, namely region behind or beneath uprights 126.

Figure 12:
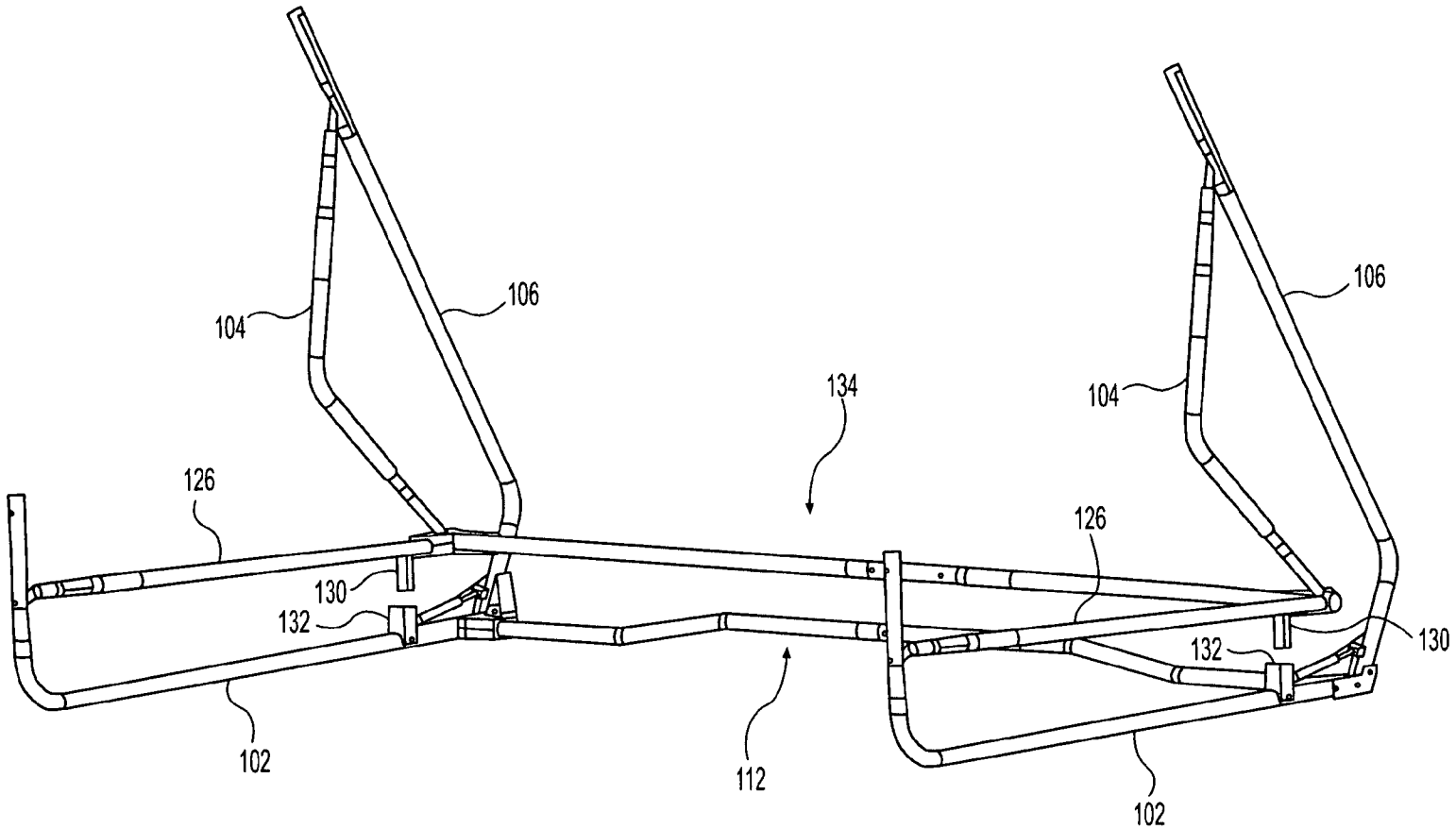
FIG. 12 illustrates the collapsible soccer goal of FIG. 1 vertically collapsed to the point that the stabilizing arms are about to engage corresponding square receptacles, in which rear support members begin to move towards the front of the goal.
Figure 13:
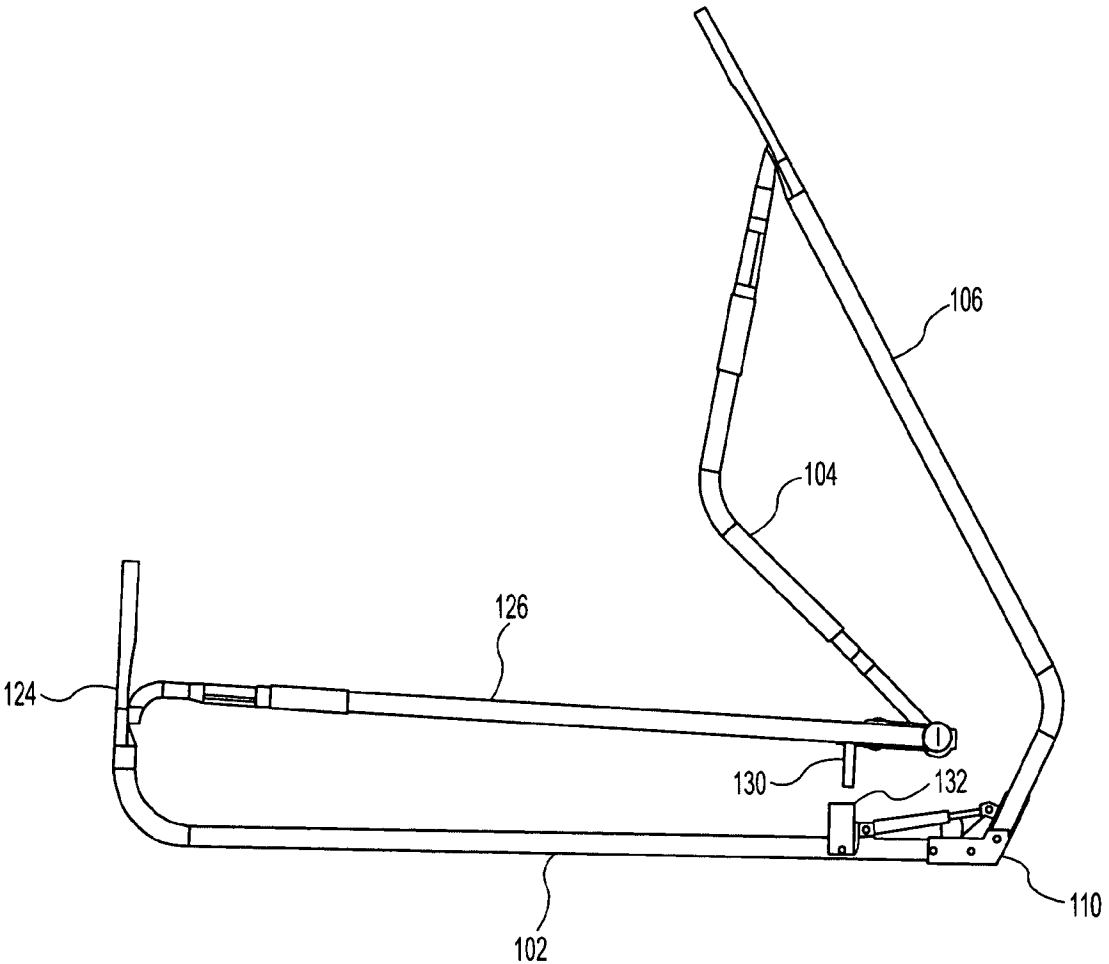
FIG. 13 is a side view of a collapsible soccer goal as shown in FIG. 12.

FIGS. 12 and 13 illustrate the position of the various components of a soccer goal according to the invention as the upper crossbar 134 and the uprights 126 descend still further to a point where the stabilizing arms 130 protruding from the uprights 126 are about to engage the square receptacles 132, which are part of or attached to ground members 102. Engagement of the stabilizer arms 130 with square receptacles 132 provides extra support for the upper crossbar 134 through the horizontal folding stages. Upper crossbar 134 will not interfere with the lower crossbar 112. The engagement of stabilizer arms 130 with square receptacles 132, this prevents uprights 126 from rotating or otherwise moving in an undesirable manner when the upper and lower crossbars 134 and 112 are later disengaged for later collapse of the goal. This will allow upper and lower crossbars 134 and 112 to move on two different planes without becoming entangled as the goal is laterally collapsed.

Figure 14:
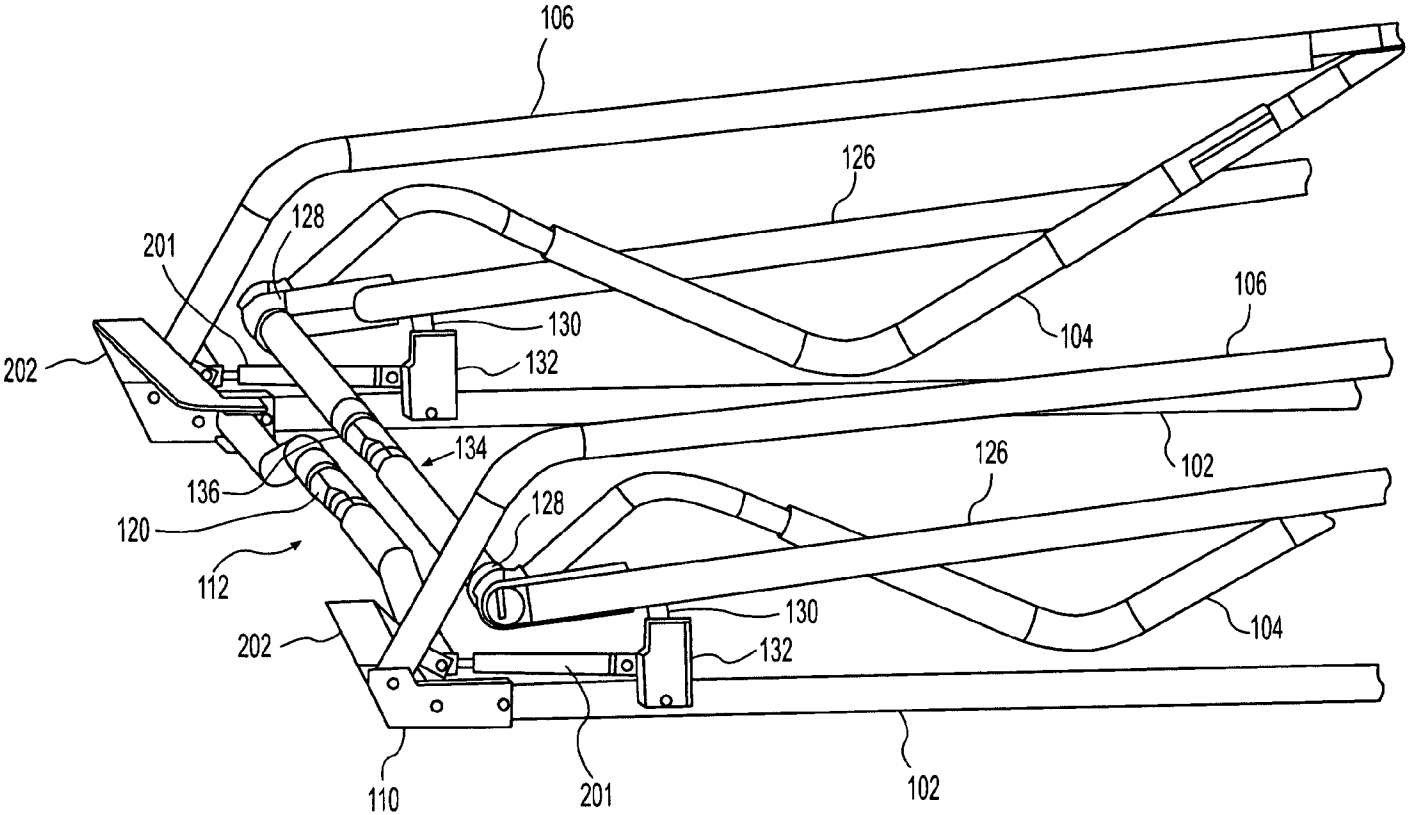
FIG. 14 is a detailed view of the engagement of stabilizer arms into the square receptacles in the soccer goal of FIG. 1 as the goal is collapsed.

FIG. 14 is a detailed view of the stabilizing arms 130 engaged in square receptacles 132. As shown in FIG. 14, in each case square receptacle 132 is part of or attached to ground member 102 in a position to receive stabilizer arm 130. By way of illustration and not limitation, in FIG. 14 square receptacle 132 are shown at a position proximate to motion dampening or resistance member 201. Optionally, as shown in FIG. 14 by way of illustration and not limitation, motion dampening or resistance member 201 may be attached to square receptacle 132, although other attachments for the resistance member 201 and square receptacle 132 are also within the scope of the invention. By way of illustration and not limitation, FIG. 14 shows stabilizer arm 130 protruding from upright 126 at a position proximate top corner bracket 128. Stabilizer arm 130 may be an element attached to upright 126 or may be formed as an integral part of upright 126. As FIG. 14 also shows, when stabilizer arm 130 is engaged in square receptacle 132 upper crossbar 134 and lower crossbar 112 are separated and cannot become entangled.

Figure 15:
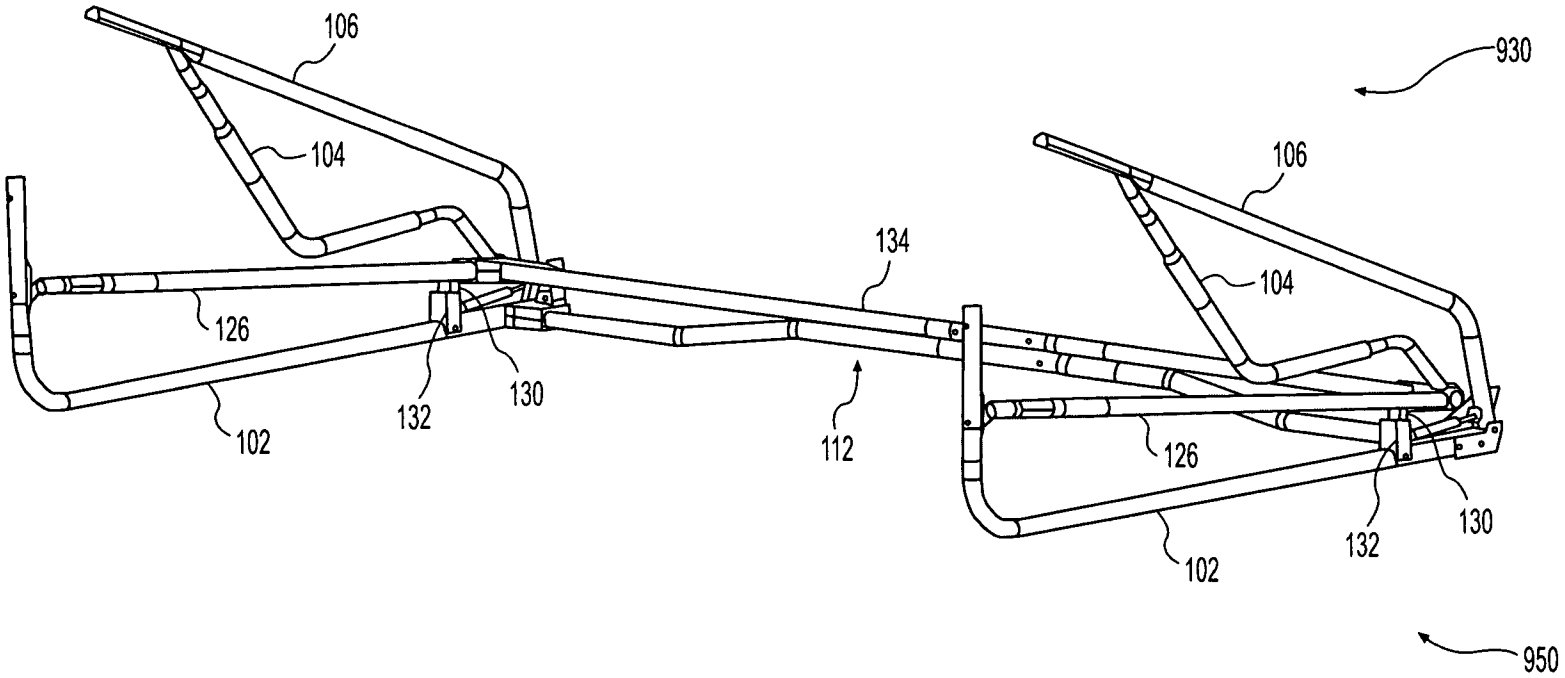
FIG. 15 illustrates the soccer goal of FIG. 1 vertically collapsed so that the stabilizer arms engage the corresponding square receptacles.
Figure 16:
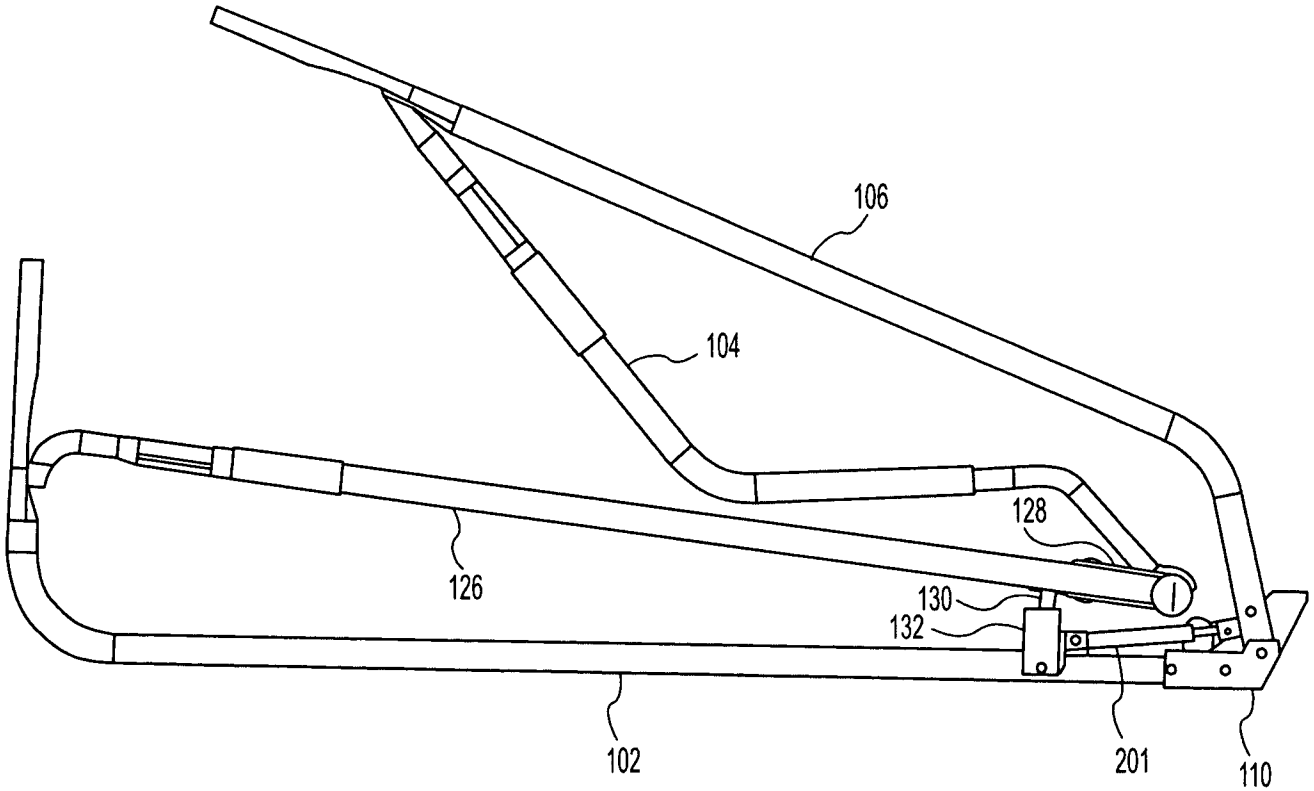
FIG. 16 illustrates the soccer goal of FIG. 1 folded such that the goal's rear support members fold into a location on top of the goal's uprights.

FIGS. 15 and 16 illustrate the position of the goal just after the stabilizer arms engage the square receptacles. At this stage of collapse, upper support member 104 is vertically above upright 126 and ground member 102. Also, at this stage of collapse, upper support member 104 is completely within region 950.

Figure 17:
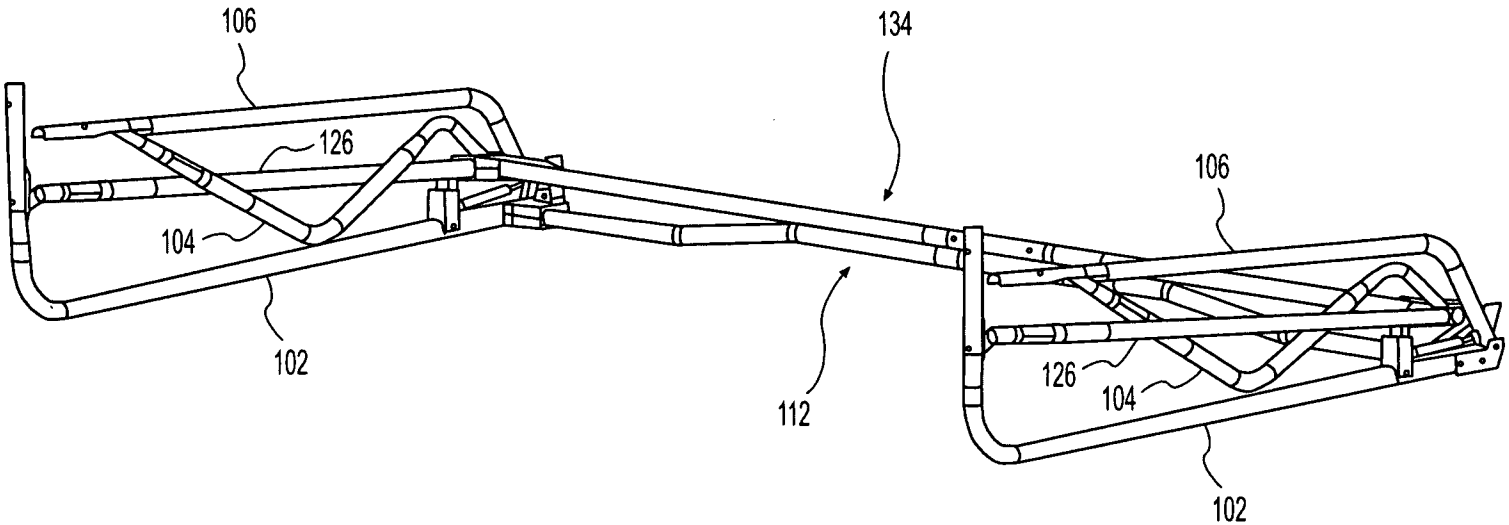
FIG. 17 shows the collapsible soccer goal of FIG. 1 in the vertically collapsed position.
Figure 18:
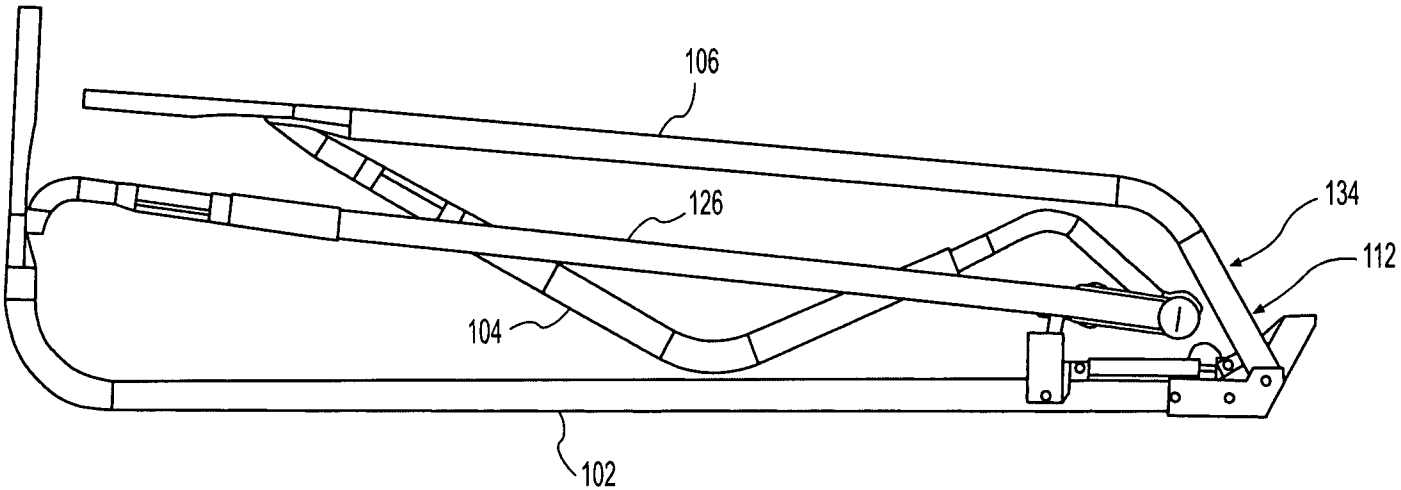
FIG. 18 is a side view of the collapsible soccer goal as shown in FIG. 17.
Figure 19:
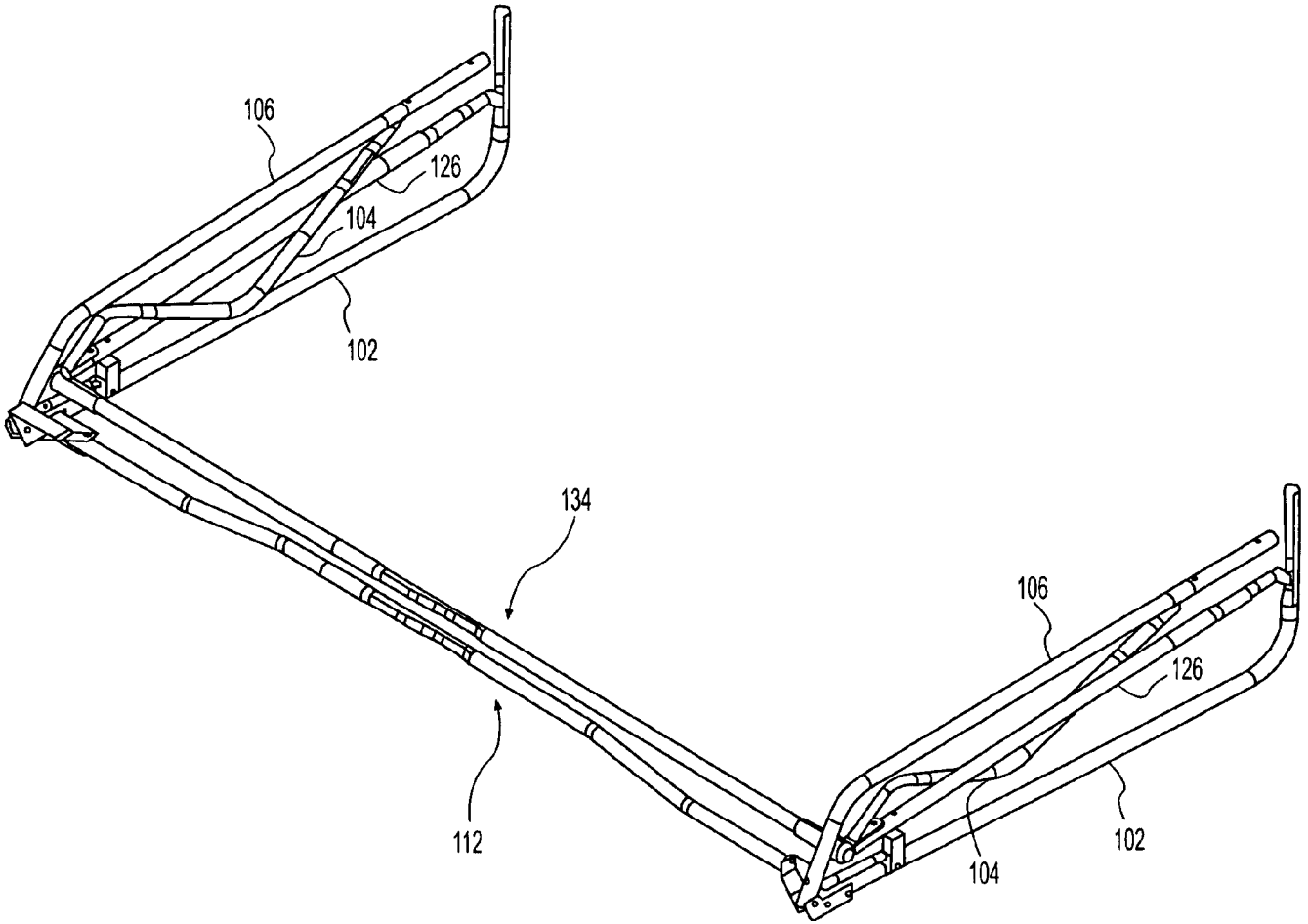
FIG. 19 is an view from the rear of the collapsible soccer goal of FIG. 1 in the vertically collapsed position.

FIGS. 17, 18 and 19 illustrate the position of the goal at the end of the first stage of collapse, from 3 different views, i.e., when the goal is completely folded vertically. At this stage of collapse, upper support member 104 has partially crossed back over plane 915, as shown in FIG. 9*a*, such that a portion of upper support member 104 is in region 950 behind or below upright 126 and a portion of upper support member 104 is in region 930 above or on top of upright 126. At this stage of collapse, most of lower support member 106 is positioned above ground member 102, upper support member 104 and upright 126, as well as upper and lower crossbars 134 and 112.

Figure 20:
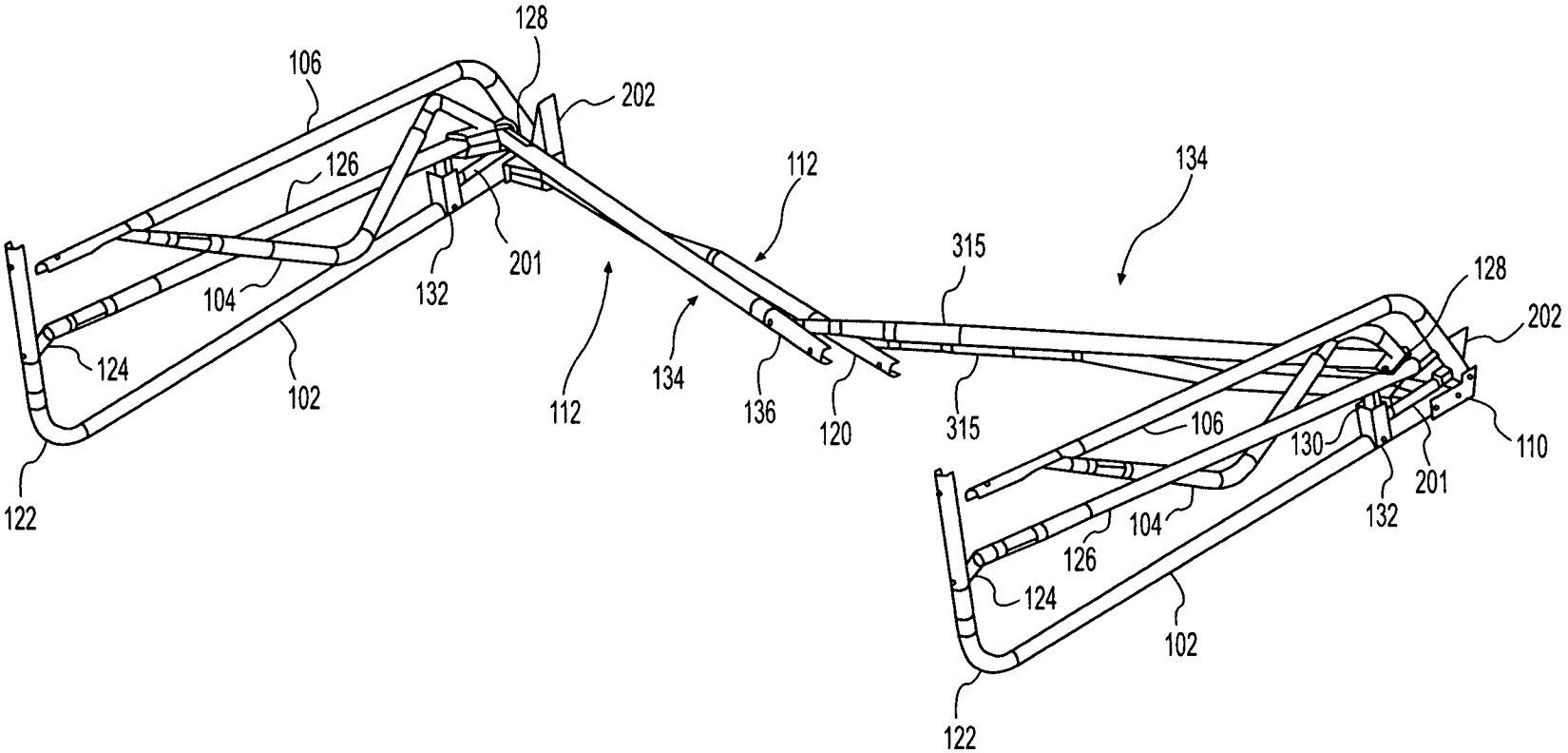
FIG. 20 is an view from the front that shows the collapsible soccer goal vertically collapsed as shown in FIG. 20 in the initial stage of lateral collapse.

After being vertically collapsed, the goal according to the invention is ready to be collapsed laterally. FIG. 20 illustrates the beginning stage of lateral collapse. A user unlocks the joints 120 and 136 on the lower and upper crossbars, respectively, by sliding the lock slider sleeves 315 to the open position. The user then begins to move the left and right sections of the goal, as shown in FIG. 20, toward each other, by folding joints 120 and 136. Typically, the user would accomplish this movement by applying pressure from behind the goal to disengage the upper and lower crossbar joints 120 and 136, by pushing them toward what had been the front plane or scoring plane of the goal, i.e., the open area of the goal in the upright position.

Figure 21:
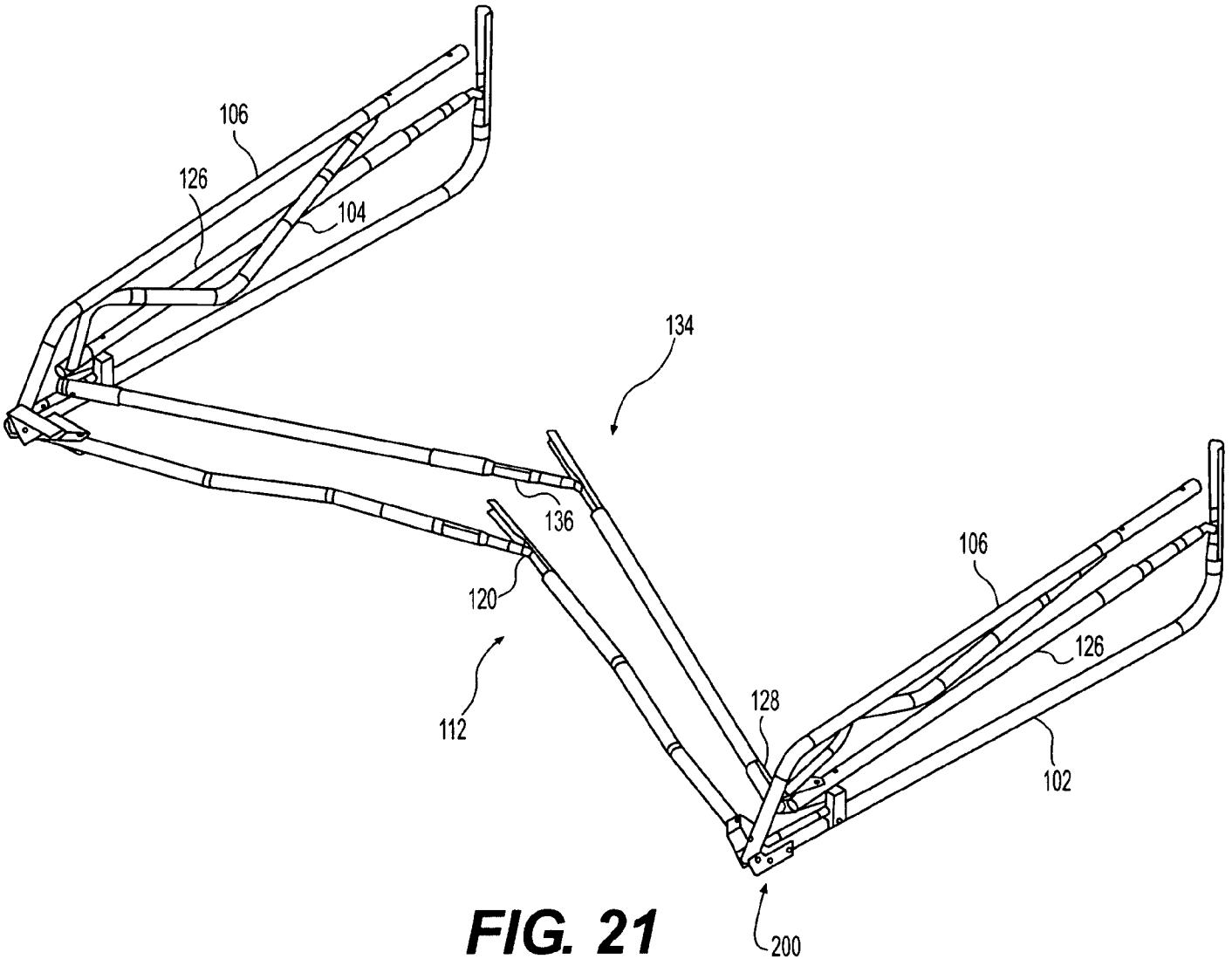
FIG. 21 is a further view of the goal according to the invention in the initial stages of lateral collapse.
Figure 22:
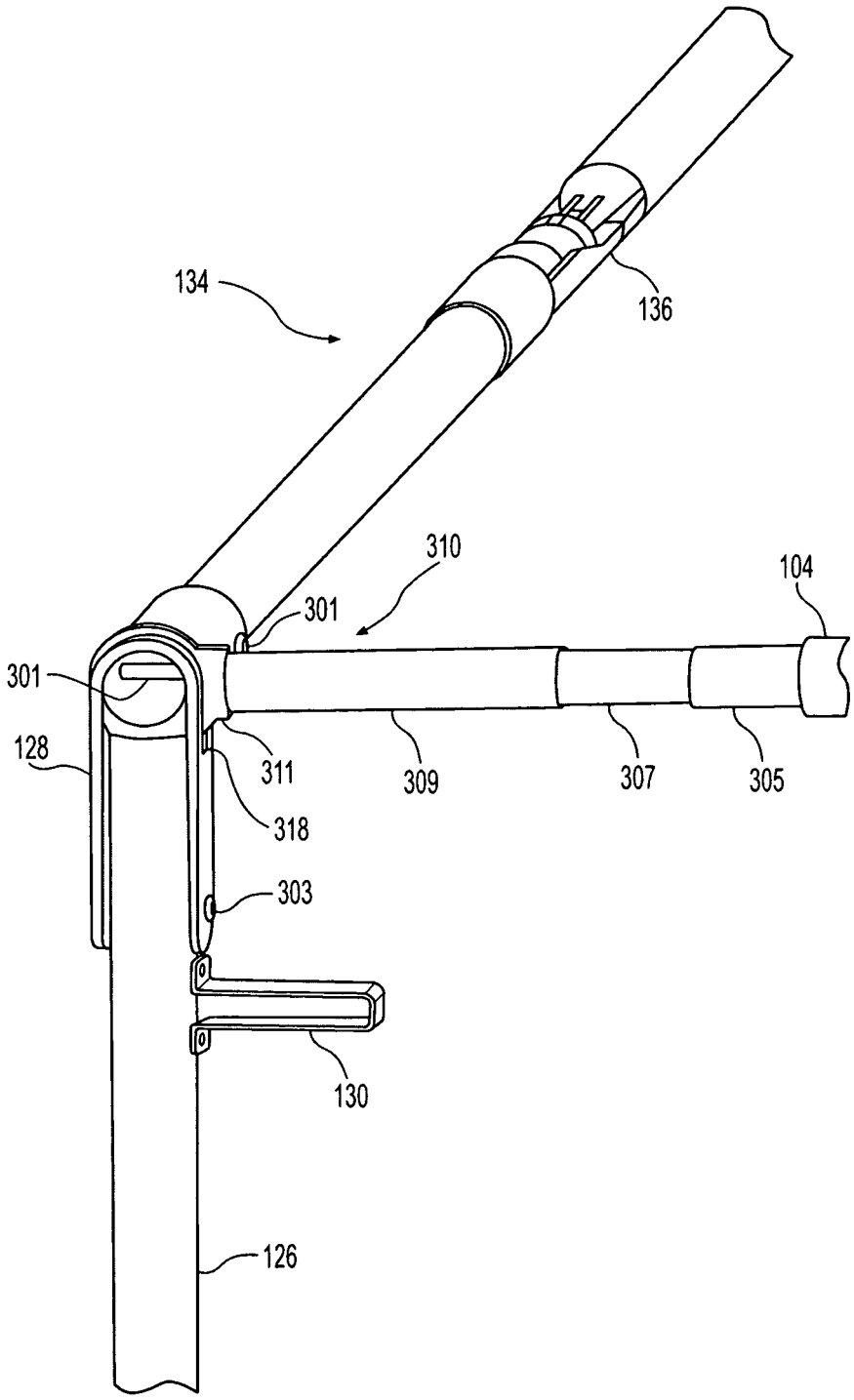
FIG. 22 is a view of the top bracket assembly showing the connection of the upper crossbar, upper rear support member and upright of the goal according to the invention.

FIG. 21 is another view of a goal according to the invention as it is collapsed laterally. FIG. 21 shows the position of the top corner bracket 128 and the rear, bottom corner joint assembly 200 when the goal is collapsed vertically and in the initial stage of lateral collapse. A more detailed discussion of these brackets follows, FIG. 22 illustrates one configuration of a top corner bracket 128 when the goal according to the invention is in the upright position. Top corner bracket 128 connects upright 126, upper rear support member 104 and upper crossbar 134. FIG. 22 illustrates that upper crossbar 134 is connected to top corner bracket 128 at fastening points or bolts 301 and that upright 126 is connected to top bracket 128 with pivoting connection 303, as discussed further herein. FIG. 22 also illustrates that upper rear support member 104 connects to transition member 305, which may be a reduced end of upper rear support member 104. One end of flexible link 307 connects to the reduced end of 305 of upper rear support member 104. A second end of flexible link 307 connects to one end of rotating tube 309. A second end of rotating tube 309 connects to rotating link 311, preferably formed of flat metal. Rotating tube 309 and rotating link 311 together form rotating arm 310. Rotating link 311 fits in a slot 318 in the top bracket 128 and operates as discussed further herein.

Figure 23:
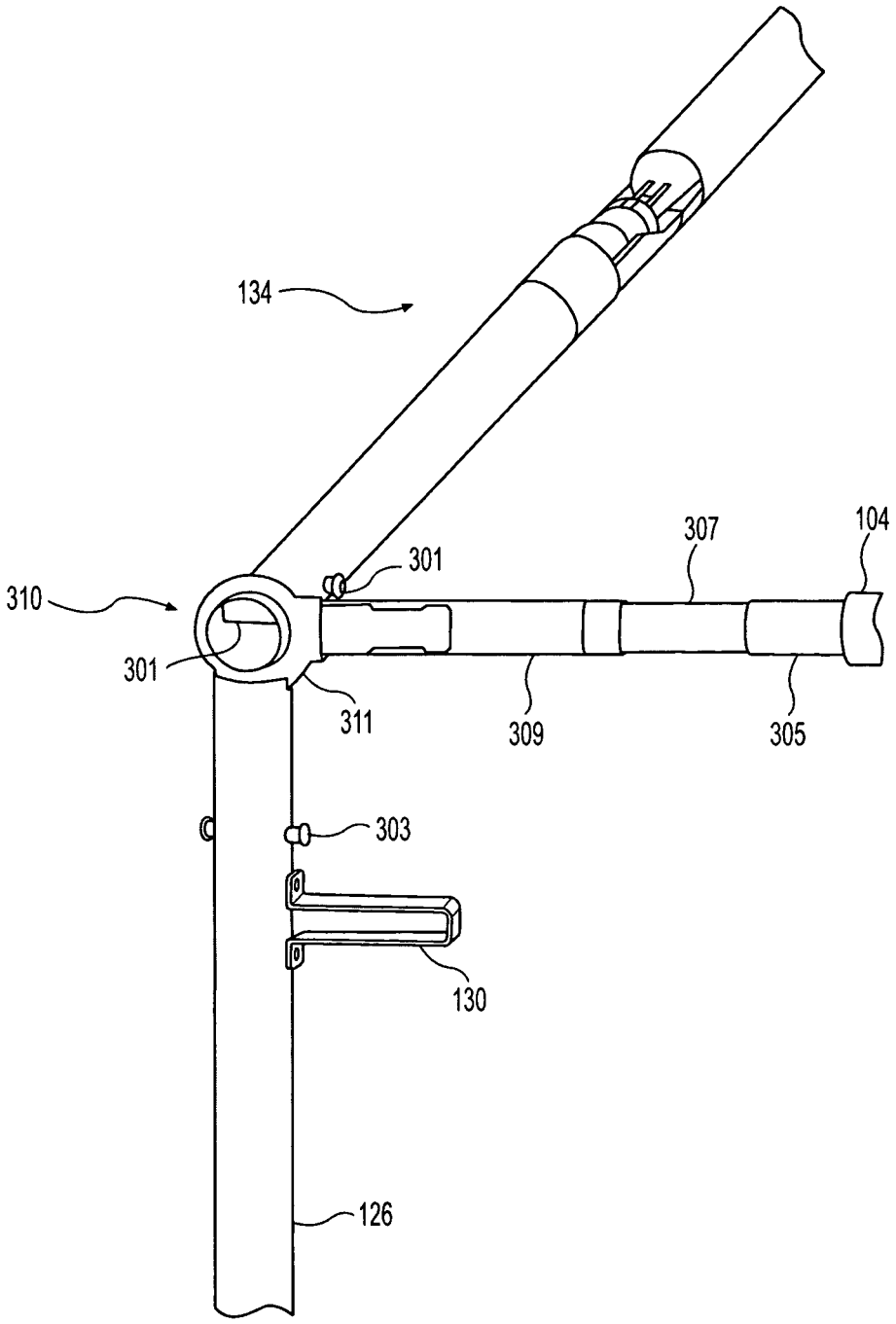
FIG. 23 shows the arrangement illustrated in FIG. 22 but with the top corner bracket not shown for purposes of illustration.

FIG. 23, which is provided for purposes of illustration, shows the arrangement discussed in FIG. 22 with the top bracket 128 not shown and rotating tube 309 as if it were translucent.

Figure 24:
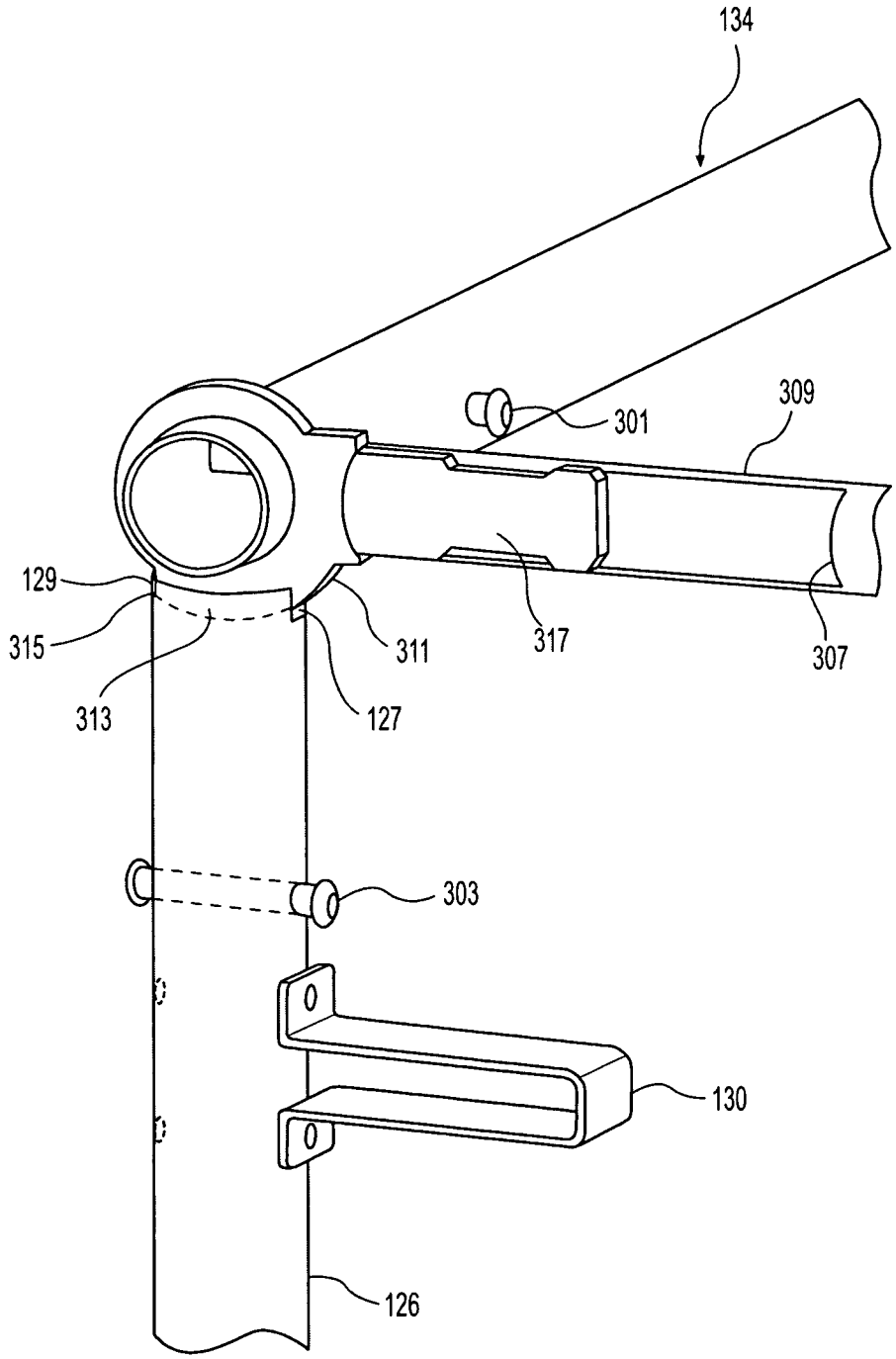
FIG. 24 is a more detailed view of the elements shown connected in FIGS. 22 and 23 with the exterior of the top corner bracket not shown for purposes of illustrating the elements and connection.
Figure 25:
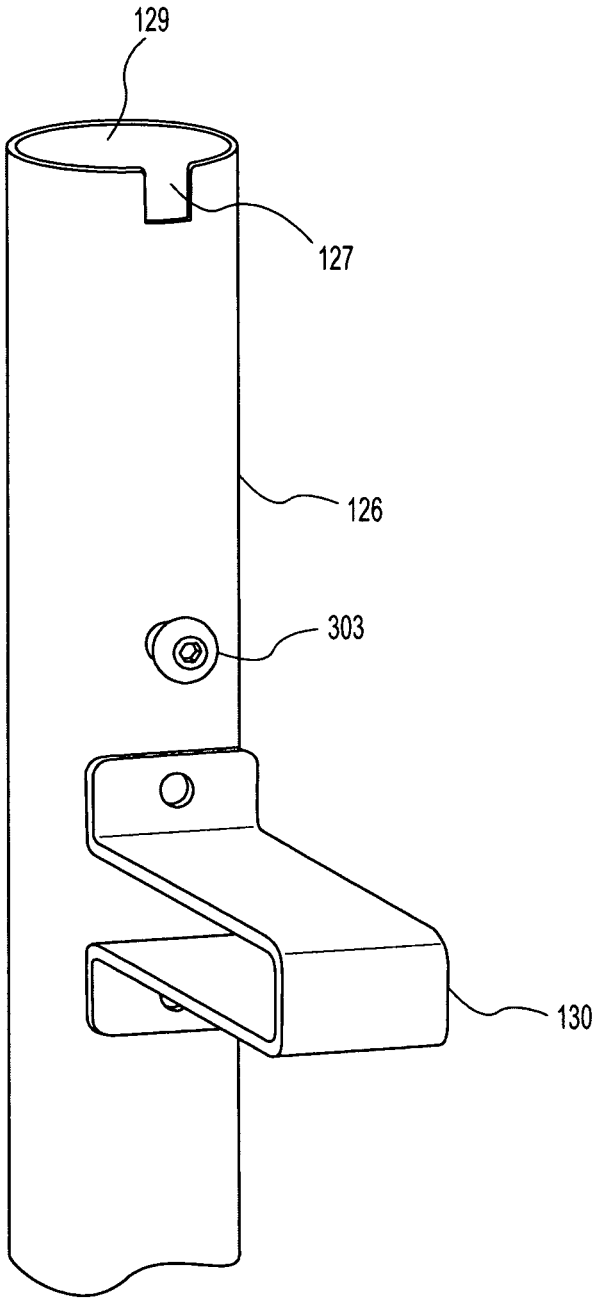
FIG. 25 illustrates the arrangement of a notch in the upright of a goal according to the invention.

FIG. 24 provides a more detailed view of the rotating link 311 and its operation, with bracket 128 removed from the drawing and rotating tube 309 and upright 126 shown as translucent for purposes of illustration. As shown in FIG. 24, one purpose of rotating link 311 is to provide a stabilizing fit when the goal is in the open position for use. Such a stabilizing fit can be accomplished with a rotating link 311 shaped to protrude into a notch 127 in the top of upright 126 when the goal is open or unfolded. Such a notch 127 is shown in FIG. 25. Preferably, as shown in FIG. 24, the protrusion portion 313 of the rotating link 311 extends through the notch 127 to a wall 129 of upright 126 opposite the opening in the upright 126 which forms notch 127. Rotating link 311 has a flattened stop section 315 which contacts wall 129 to prevent further rotation of rotating member 311 when the goal is in the upright position. This contact also adds stability to the open goal. This helps to properly position the upright 126 relative to the other elements of the goal in the upright position. As the goal is folded vertically rotating link 311 turns on crossbar 134 and protrusion portion 313 is disengaged from notch 127 in upright 126. This allows upright 126 to pivot on pivot point 303, during the lateral collapsing of the goal.

Preferably, protrusion portion 313 of rotating link 311 only exists on one side of the rotating link 311. As a result, the rotating link 311 rotates during vertical collapse around crossbar 134 and no protrusion is present in notch 127 during lateral collapse. The absence of a protrusion into the notch 127 during lateral collapse allows upright 126 to pivot relative to upper crossbar 134 and the top corner bracket 128 as the goal is collapsed. However, when the goal is in the open position, protrusion 313 is engaged in notch 127 and an interference fit between the notch 127 and the protrusion portion 313 prevents lateral movement of upright 126. In other words, when the goal is in the open position, with protrusion 313 engaged in notch 127, there is an interference fit between upright 126 and rotating link 311 preventing upright 126 from moving on pivot connection 303. This interference fit between protrusion 313 and notch 127 works to stabilize the goal when in use.

FIG. 24 further illustrates portion 317 extending from rotating link 311 into rotating tube 309 to connect the rotating tube to the rotating link.

Figure 26:
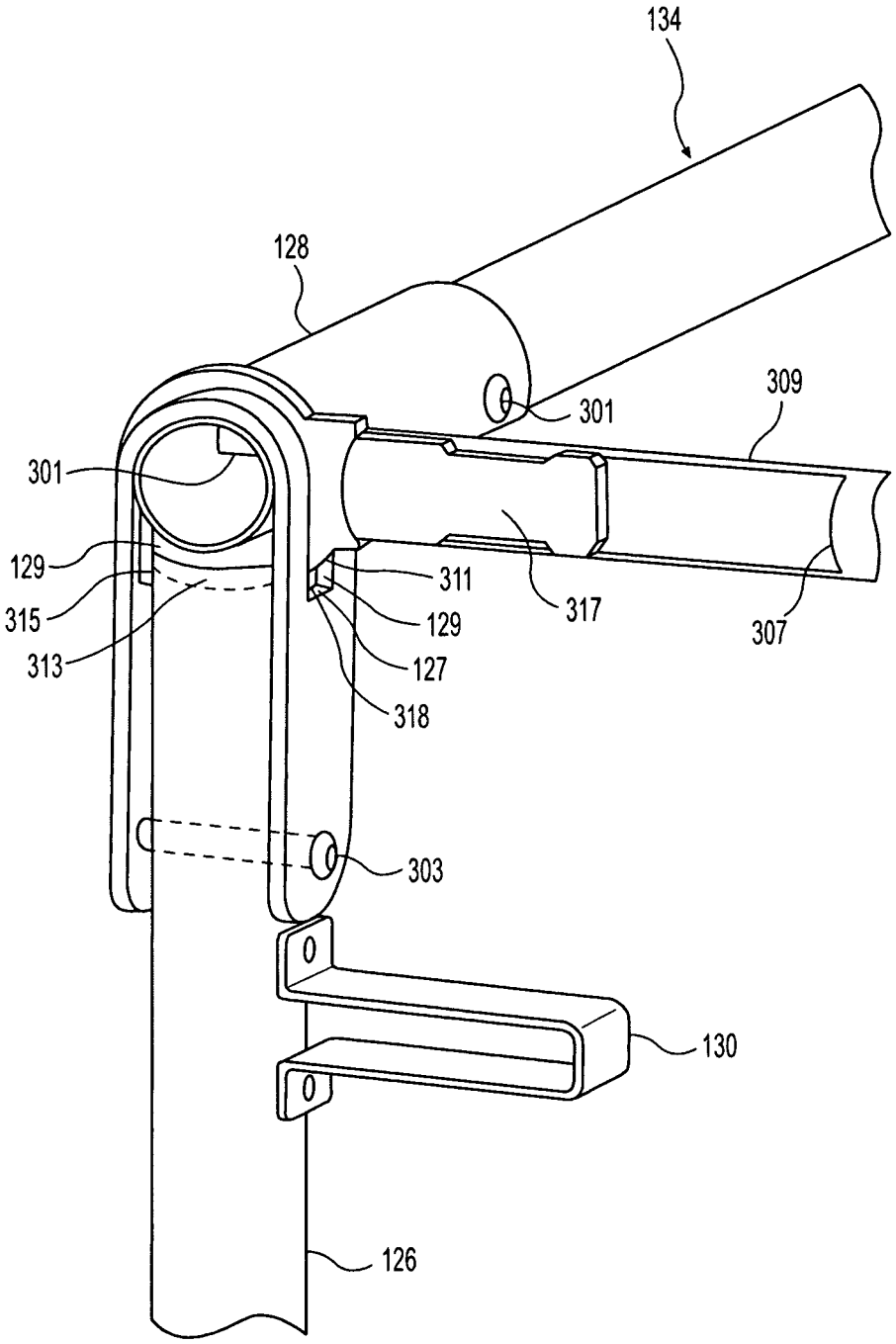
FIG. 26 illustrates the detailed arrangement shown in FIG. 24 with the top bracket shown in place.

FIG. 26 is a more detailed illustration of the mechanism shown in FIGS. 22-25 with the top corner bracket 128 and rotating tube 309 and upright 126 shown in place transparently with the goal in the open position. Note that the bracket 128 has a slot 129 aligned with the notch 127 in upright 126 in order to accommodate rotation of section 313 of rotating link 311. Top bracket 128, which has a generally right angle shape, connects through rotating pivot 303 to upright 126 at one end of the bracket and to top crossbar 134, at fastening points 301 at the other end of the bracket.

Figure 27:
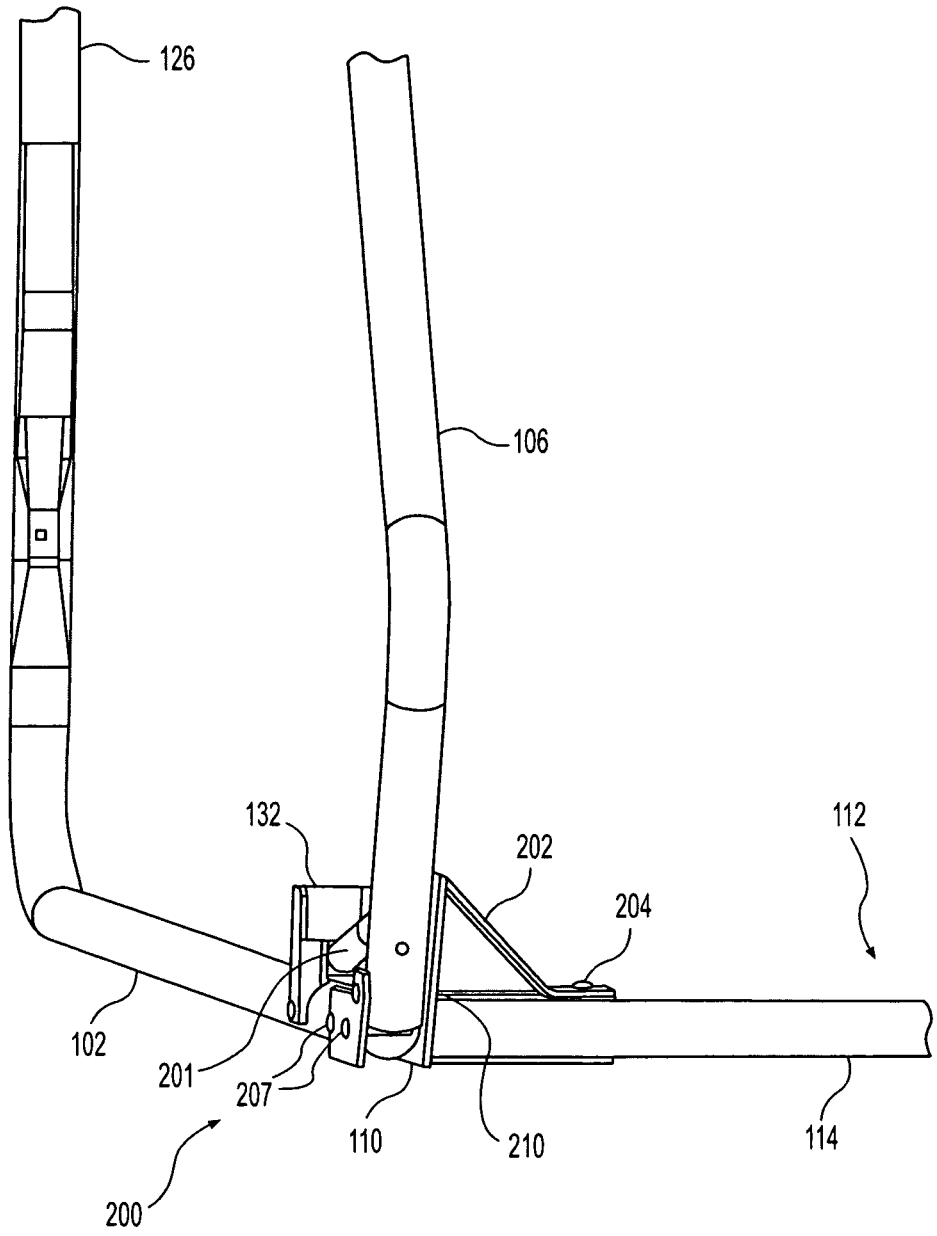
FIG. 27 illustrates the rear bracket assembly in the goal according to the invention.

FIG. 27 illustrates one possible configuration of the rear bottom corner brackets assembly 200 in a goal according to the invention. Ground bracket 110 provides a means for connecting lower rear support member 106 to ground member 102 by means of fastening points or bolts 207 and pivot point 210. As previously discussed, square receptacle 132 is connected to the ground member 102. Angle bracket element 202 of rear bottom corner bracket 110 provides support to lower rear support member 106 on the inside of lower rear support member 106, i.e., the center of the goal. When the goal is in the upright position, angle member 202 supports the lower rear support member 106, thereby helping to keep the rear support members square under the weight of the net. Rear ground corner bracket 110 also connects section 114 of lower crossbar 112 by a bolt and pivot connection 204 to facilitate lateral collapse of the goal. As previously discussed, motion dampening or resistance member 201 provides a safety by preventing the goal from collapsing too fast. Preferably, resistive element 201 is unidirectional in the compression mode, so that the goal raises easily but provides a controlled collapse, for example by requiring the user to apply pressure to the goal to overcome the resistance of resistive element 201 when vertically collapsing the goal.

Figure 28:
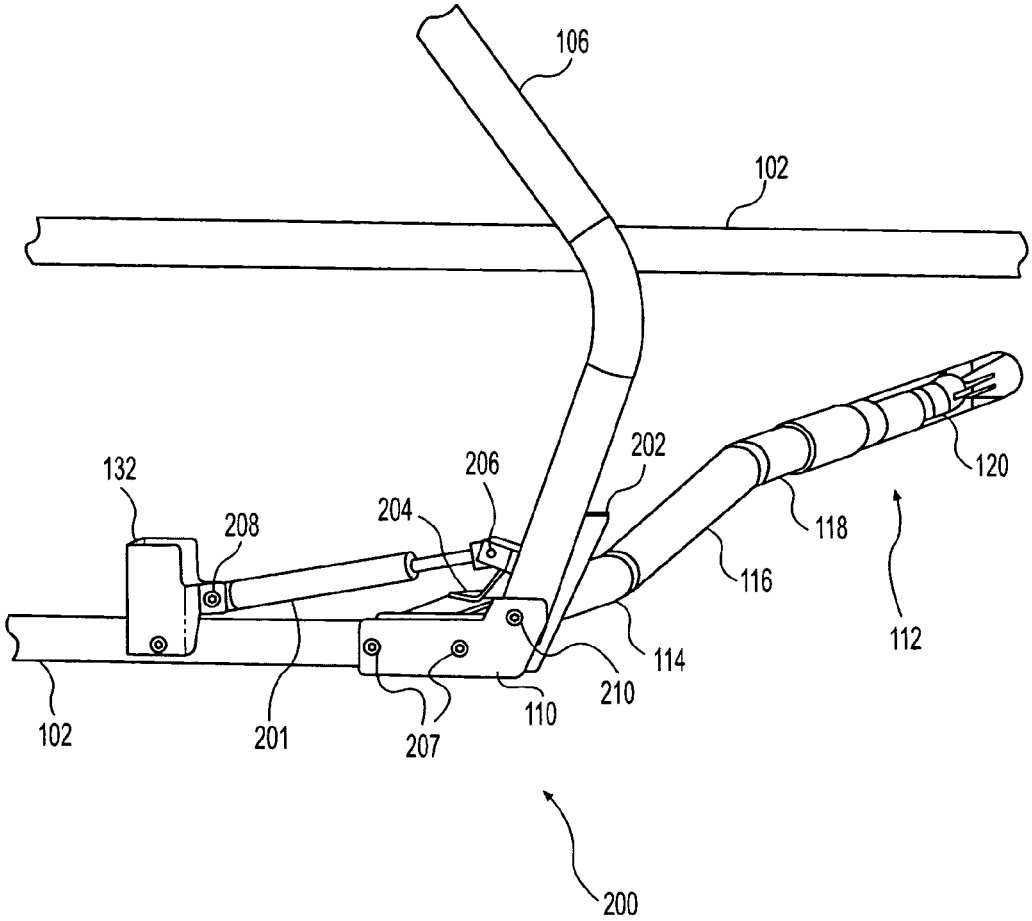
FIG. 28 is a side view of a rear bracket assembly on a goal according to the invention.

FIG. 28 is a side view of the rear ground corner bracket assembly 200 with additional elements shown. As shown in FIG. 2, resistive element 201 is connected between the ground member 102 and lower rear support member 106 to provide a controlled collapse. By way of illustration and not limitation, in FIG. 28, the connection of resistive element 201 is made by pivotal connection 206 to the lower rear support member 106 and pivotal connection 208 to the square receptacle 132, which is connected to the ground member 102. FIG. 28 also shows pivot point 210 which one end of lower rear support member 106 rotates on.

Figure 29:
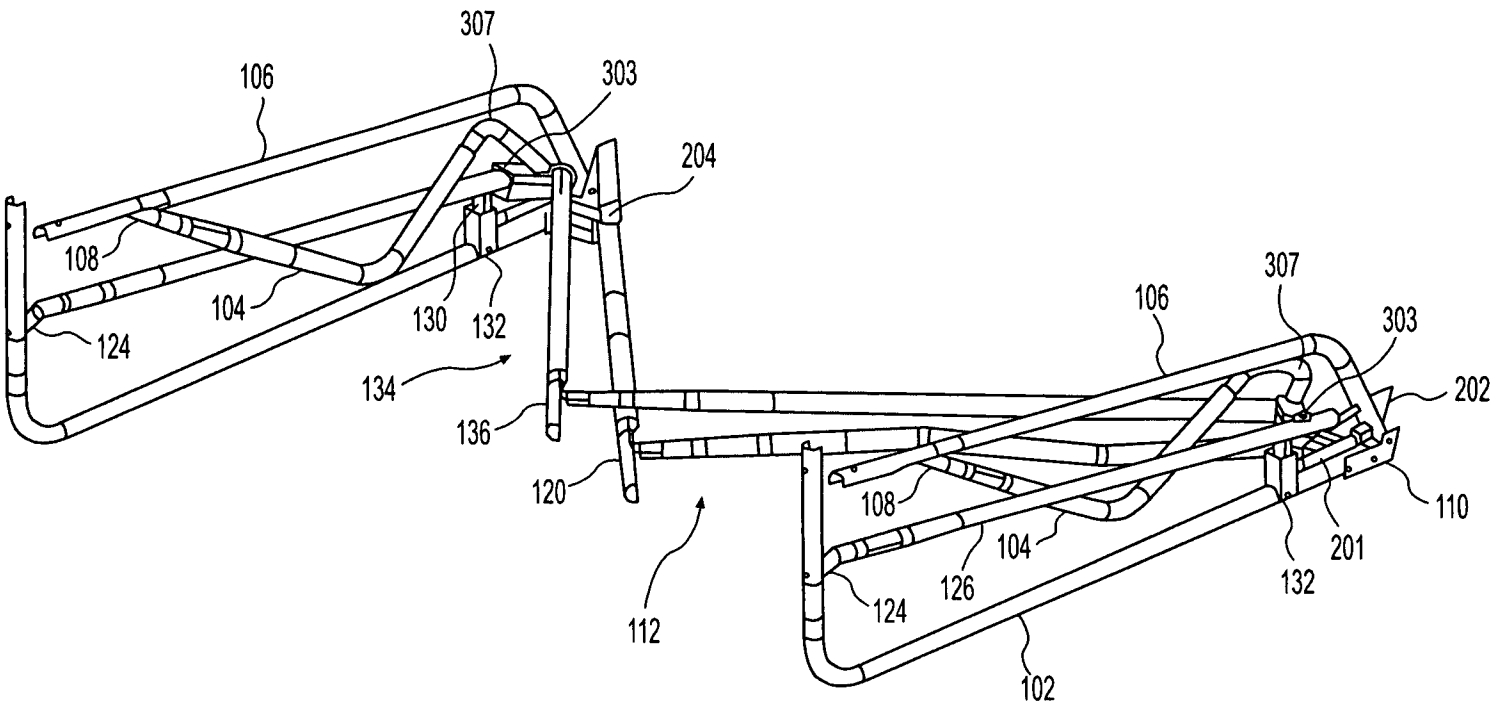
FIG. 29 illustrates a further stage of lateral collapse of a goal according to the invention.
Figure 30:
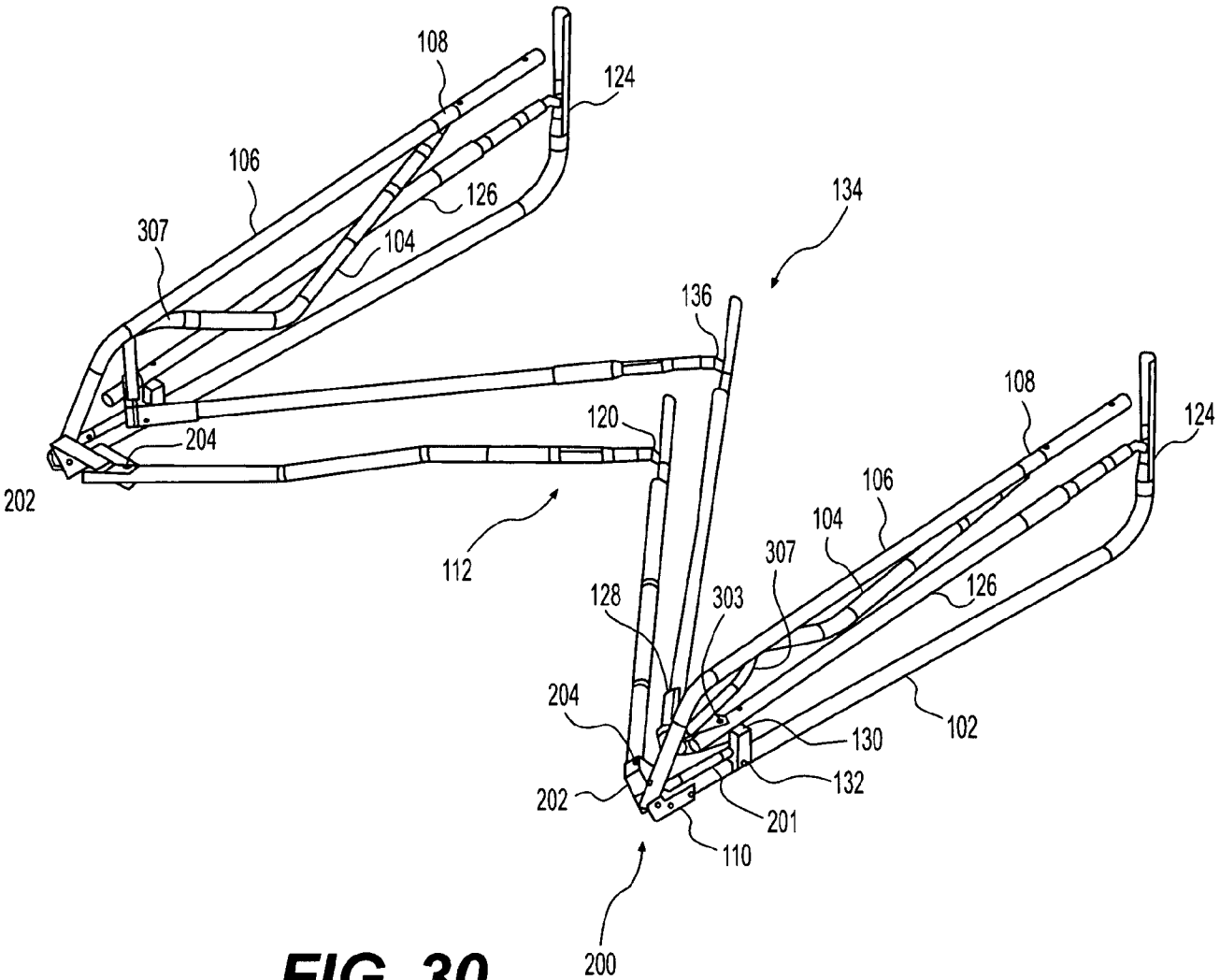
FIG. 30 illustrates the stage of lateral collapse of FIG. 29 as seen from a different direction.

FIG. 29 illustrates the goal according to the invention in a further stage of lateral collapse, as the goal is collapsed from the sides toward the center. FIG. 30 illustrates the same stage of collapse, as seen from another angle. During lateral collapse, joints 136 and 120 permit upper and lower crossbars 134 and 112 respectively to approach each other and to move toward the area corresponding to the open portion of the goal in the upright position. Top bracket 128 and pivot 303 permits the upper crossbar 134 to pivot relative to upright 126. In a similar fashion, bolt and pivot 204, which is pivotally connected to ground section 114 of lower crossbar 112 permits the lower crossbar 112 to pivot relative to the ground member 102. Simultaneously, flex link 307 flexes and twists to allow upper rear support member 104 to remain stationary as top corner bracket 128 pivots on pivot point 303.

Figure 31:
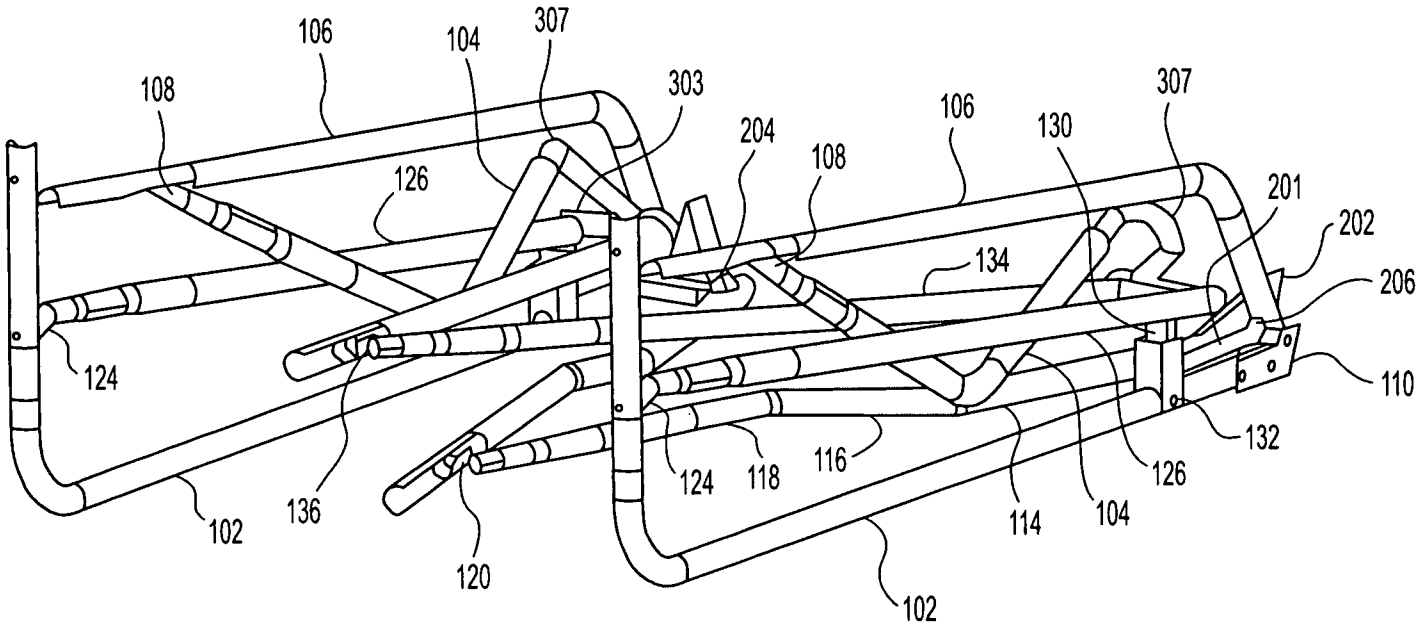
FIG. 31 illustrates the goal according to the invention in a still further stage of lateral collapse.
Figure 32:
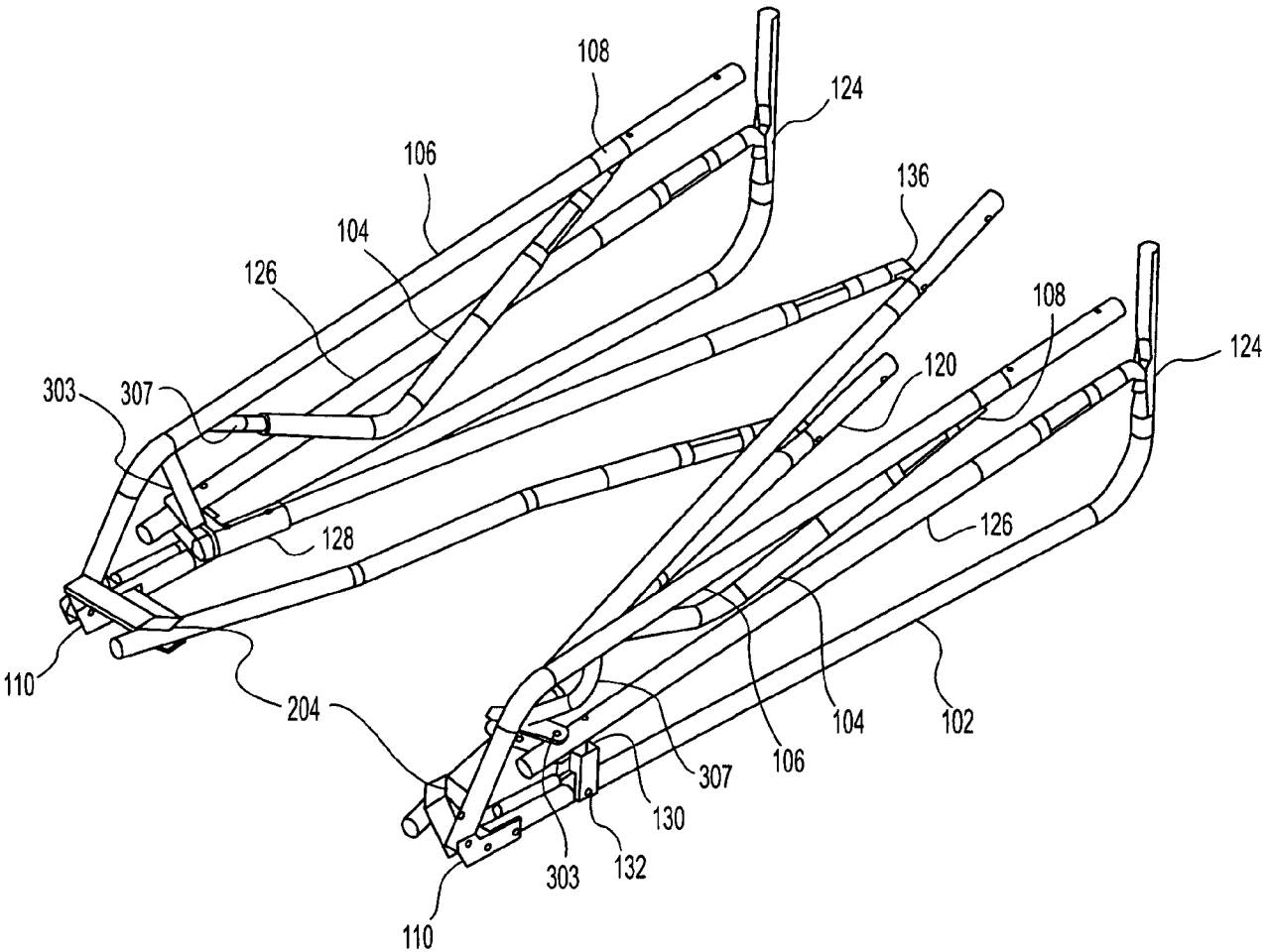
FIG. 32 illustrates the stage of lateral collapse shown in FIG. 31 as seen from another perspective.
Figure 33:
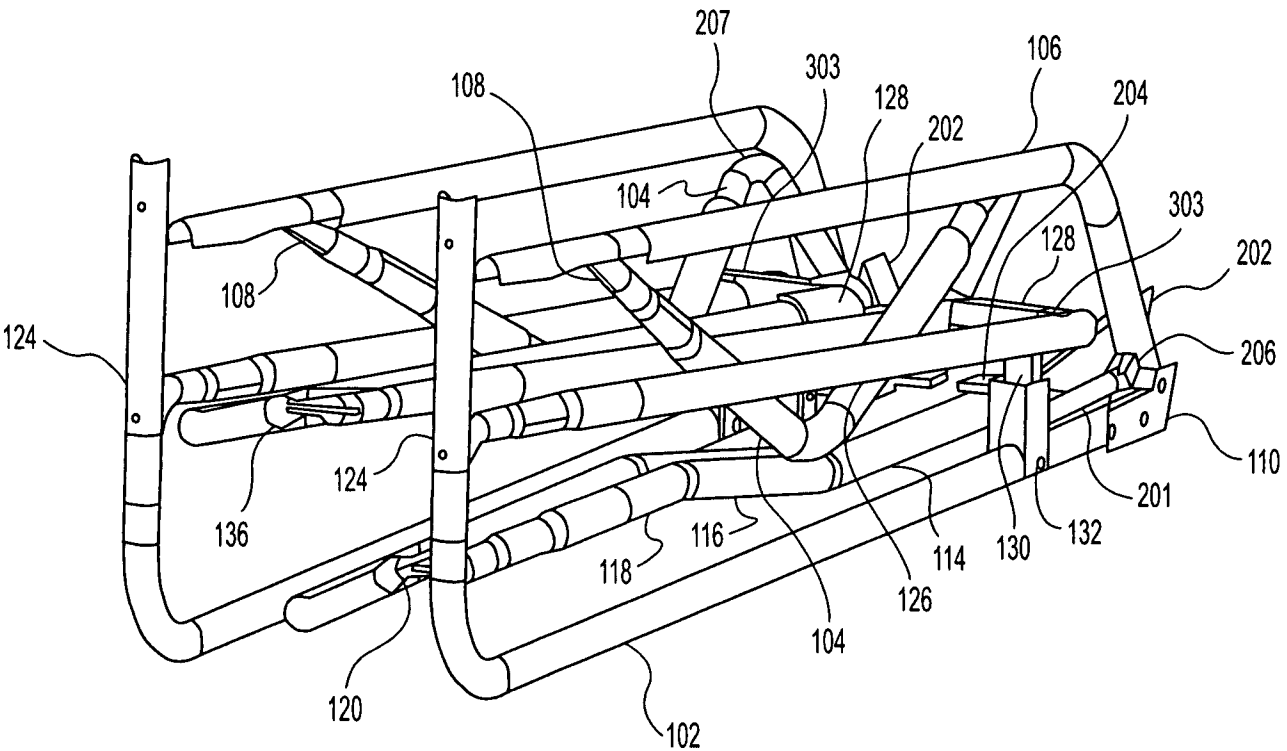
FIG. 33 illustrates the goal according to the invention as fully collapsed.
Figure 34:
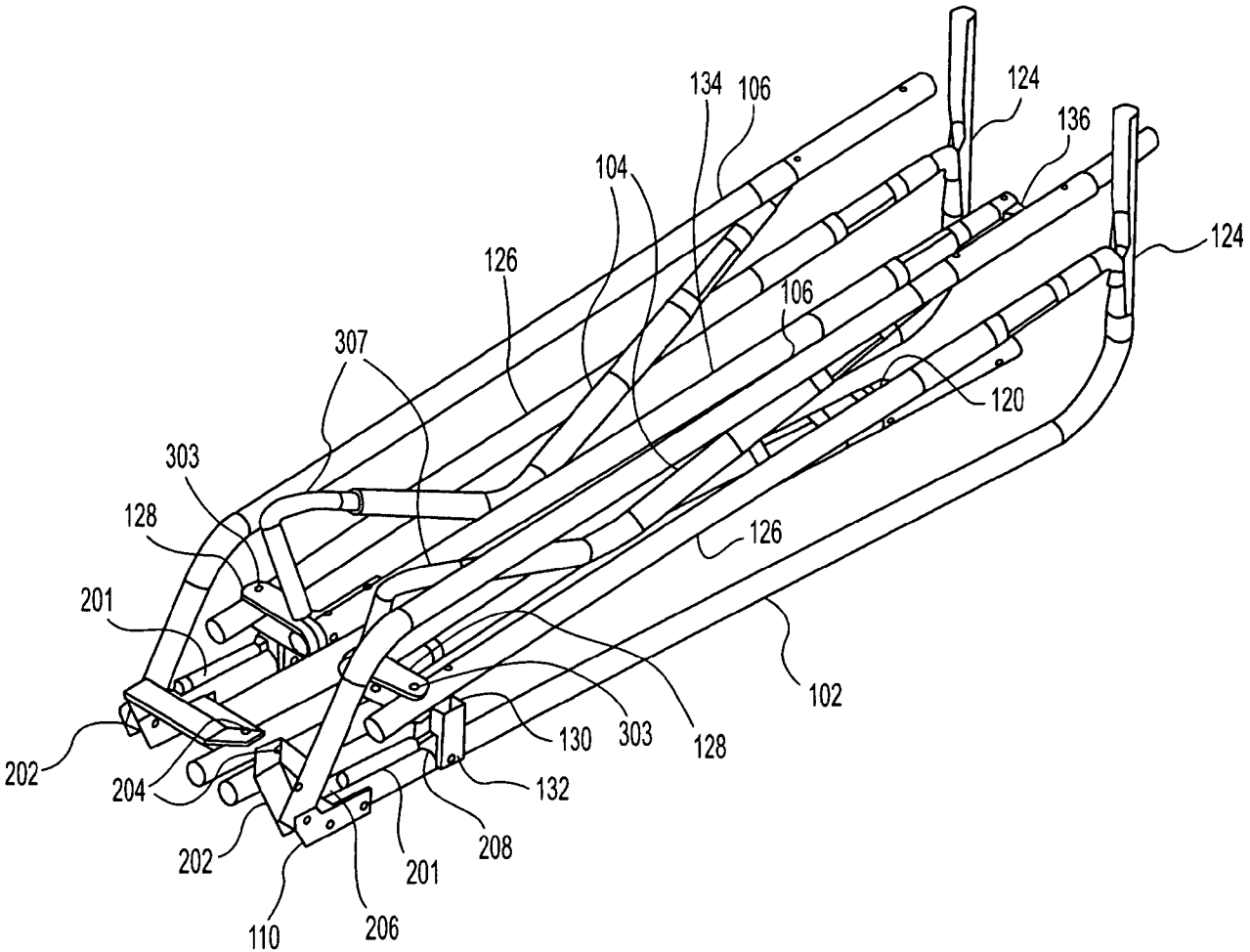
FIG. 34 illustrates the goal according to the invention as fully collapsed as seen from a different perspective from that shown in FIG. 33.

FIGS. 31 and 32 illustrate the goal in a still further stage of lateral collapse. FIGS. 33 and 34 illustrate the goal according to the invention in the fully collapsed position.

What is claimed is:

1. A collapsible game goal comprising:

a frame operable into a storage configuration when collapsed and into a game-ready configuration when opened, the frame transitioning from the game-ready configuration to the storage configuration through a first partially collapsed state and a second partially collapsed state, the frame comprising:

an upright;

a ground member mechanically coupled to the upright;

an upper rear support member mechanically coupled to the upright at an end thereof opposite that to which the ground member is coupled;

a lower rear support member mechanically coupled to the ground member at an end thereof opposite that to which the upright is coupled; and a plurality of joints interposed between the upright, the ground member and the upper and lower rear support members, the joints being mechanically cooperative such that rotation of the upright towards the ground member to collapse the goal into the first partially collapsed state compels the upper rear support member to rotate towards the lower rear support member and compels the lower rear support member to rotate away from the ground member, the joints being inseparable from ends of the upright, the ground member and the upper and lower rear support members throughout the rotation of the upright towards the ground member.

2. The collapsible game goal of claim 1, wherein the lower rear support member is compelled towards both the upright and the ground member to collapse the frame from the first partially collapsed state into the second partially collapsed state.

3. The collapsible game goal of claim 2 further comprising:

a rotating joint included in the joints and interposed between the upright and the upper rear support member, the joints being mechanically cooperative such that collapsing the goal into the first partially collapsed state compels the rotating joint through greater than ninety degrees rotation.

4. The collapsible goal of claim 3, wherein the rotating joint is compelled through additional rotation in like direction as the rotation responsive to rotation of the lower rear support member towards the upright and the ground member.

5. A collapsible game goal comprising:

an upright;

an upper crossbar coupled to the upright;

an upper rear support member; and a rotating link mechanically coupled to the upper rear support member and rotatable around the upper crossbar through an angle of greater than 90 degrees, the rotating link being compelled to rotate around the upper crossbar responsive to the upright being rotated toward the upper rear support member.

6. The collapsible game goal recited in claim 5, further comprising:

a notch in the upright;

a top corner bracket connected to the upper crossbar and the upright, the top corner bracket having a slot therein, wherein the rotating link is received into and engaging the notch when the goal is opened into a fully open game-ready position.

7. The collapsible game goal of claim 5, wherein the angle of greater than 90 degrees through which the rotating link is rotatable is greater than 180 degrees.

8. The collapsible game goal of claim 5, wherein the upright and the upper crossbar are held against relative rotation therebetween by a mechanical connection preventing the upper crossbar from rotating about an axis that is perpendicular to the upright.

9. The collapsible game goal of claim 5 further comprising:

a lower rear support member mechanically coupled to the upper rear support member at an end thereof opposite that to which the rotating link is mechanically coupled to the upper rear support member.

10. The collapsible game goal of claim 9, wherein the rotating link is coupled to the upper rear support member such that the upper rear support member is rotatable around the upper crossbar through the angle of greater than 90 degrees.

11. A collapsible game goal comprising:

a frame mechanically operable into a completely-collapsed storage configuration and into a completely-opened game-ready configuration, the game-ready configuration defining a scoring plane and a playing surface plane perpendicular one to another, the frame transitioning from the game-ready configuration to the storage configuration, and vice-versa, through a first partially collapsed state and a second partially collapsed state, the frame comprising:

a plurality of frame members inseparable one from the other by actuation of the frame from the game-ready configuration to the storage configuration, and vice-versa, the frame members including:

a scoring plane member that is positioned in the scoring plane when the frame is in the game-ready configuration; and a surface plane member that is positioned in the playing surface plane when the frame is in the game-ready configuration; and a plurality of joints interposed between the frame members to allow relative rotation therebetween, the joints being mechanically cooperative in a manner that compels at least one of the frame members to rotate in a direction away from the surface plane member responsive to rotation of the scoring plane member towards the surface plane member to collapse the frame from the game-ready configuration into the first partially collapsed state, wherein the second partially collapsed state is achieved by the one of the members that rotated away from the surface plane member being subsequently rotated towards the surface plane member.

12. The collapsible game goal of claim 11 further comprising:

a pair of uprights included in the frame members and including the scoring plane member;

a pair of segmented rear support members included in the frame members to support the uprights in a forward position when the frame is in the game-ready configuration; and a plurality of pivot joints included in the joints and interposed between the segments of the rear support members such that one of the segments is the one of the members that rotates away from the scoring plane in collapsing the frame from the game-ready configuration into the first partially collapsed state.

13. The collapsible game goal of claim 12, wherein the joints are mechanically cooperative such that the scoring plane member is compelled to rotate further towards the surface plane member responsive to the one of the segments of the rear support member being rotated towards the surface plane member to collapse the goal from the first partially collapsed state into the second partially collapsed state.

14. The collapsible game goal of claim 13 further comprising:

a segmented crossbar included in the frame members and interposed between the uprights, the crossbar defining a separation distance between the uprights when the frame is in the game ready configuration; and at least another pivot joint included in the joints and interposed between the segments of the crossbar, the joints being mechanically cooperative to compel the segments of the crossbar to rotate towards respective uprights responsive to a decrease in the separation distance between the uprights as the frame is collapsed from the second partially collapsed state into the storage configuration.

15. The collapsible game goal of claim 14 further comprising:

a pair of stabilizer arms on the respective uprights;

a pair of receptacles on the respective ground members, the receptacles having respective holes of complementary shape to a cross-sectional shape of the stabilizer arms, wherein the stabilizer arms are separated from the respective receptacles when the frame is in the first partially collapsed state and the stabilizer arms are compelled into the respective receptacles by collapsing the frame into the second partially collapsed state from the first partially collapsed state and remain coupled one to the other as the frame is compelled from the second partially collapsed state into the storage configuration.

16. A collapsible game goal comprising:

a plurality of frame members; and a plurality of joints interposed between the frame members to define a scoring plane by a scoring plane set thereof, a surface plane by a surface plane set thereof and a side plane by a side plane set thereof, the scoring plane, the surface plane and the side plane being mutually orthogonal one to the others when the goal is in a completely-open game-ready configuration, the joints being mechanically cooperative during opening of the goal from a completely-collapsed storage configuration into a first partially opened state in a manner that compels relative rotation between the frame members of the scoring plane set while the frame members of the side plane set remain relatively stationary each to the other, the joints being further mechanically cooperative during opening of the goal from the first partially opened state into a second partially opened state in a manner that compels relative rotation between the frame members of the side plane set while the frame members of the scoring plane set remain relatively stationary each to the other.

17. The collapsible game goal of claim 16, wherein the joints are mechanically cooperative in a manner that compels rotation of an upright included in the side plane set away from the surface plane responsive to rotating a lower rear support member included in the side plane set to open the goal from the first partially opened state to the second partially opened state, the joints being further mechanically cooperative in a manner that compels rotation of the lower rear support member of the side plane set toward the surface plane responsive to rotation of the upright toward the scoring plane to open the goal from the second partially opened state into the game-ready configuration.

18. The collapsible game goal of claim 17, wherein the joints are mechanically cooperative such that rotation of an upper rear support member included in the side plane set rotates through an angle of greater than 180° around the upright as the goal is opened from the first partially opened state to the game-ready configuration.

19. The collapsible game goal of claim 18 further comprising:

a pivot joint interposed between the upright and the upper rear support member to rotate about an axis defined by a crossbar included in the scoring plane set, the pivot joint affording the greater than 180° rotation.

20. The collapsible game goal of claim 19, wherein the pivot joint includes a rotating link through which the upright is received, the rotating link including a protrusion portion to be received into a notch formed in the upright as the goal is opened from the second partially opened state into the game-ready configuration.

21. The collapsible game goal of claim 20, wherein the protrusion portion of the rotating link includes a stepped outer diameter to engage sides of the notch when the goal is in the game-ready configuration and to disengage from the sides of the notch as the goal is collapsed.

22. The collapsible game goal of claim 21 further comprising:

a top bracket mechanically coupled to both the upright and the crossbar in a manner that compels the rotating link into the notch when the goal is in the game-ready configuration.

23. The collapsible game goal of claim 22, wherein the upright is pivotally coupled to the top bracket on an axis of rotation perpendicular to that of the rotating link.

24. The collapsible game goal of claim 23, further comprising:

a lower crossbar included in the surface plane set and having at least one joint interposed between segments thereof that is spatially aligned with the pivot joint interposed between the segments of the crossbar such that relative rotation of segments of the lower crossbar is compelled in like manner with the relative rotation of the segments of the crossbar.

* * * * *